US005395744A

United States Patent [19]

Sowinski et al.

[11] Patent Number: 5,395,744

[45] Date of Patent: Mar. 7, 1995

[54] COLOR PHOTOGRAPHIC SILVER HALIDE NEGATIVE IMAGING PROCESS AND MATERIAL COMPRISING TABULAR SILVER HALIDE GRAINS, DEVELOPMENT INHIBITOR RELEASING COMPOUNDS AND DISTRIBUTED DYES

[75] Inventors: Allan F. Sowinski; Richard P. Szajewski; James P. Merrill, all of Rochester, N.Y.

[73] Assignee: Eastman Kodak Company, Rochester, N.Y.

[21] Appl. No.: 135,701

[22] Filed: Oct. 13, 1993

Related U.S. Application Data

[63] Continuation-in-part of Ser. No. 869,675, Apr. 16, 1992, abandoned.

[51] Int. Cl.[6] ..... G03C 1/08

[52] U.S. Cl. ..... 430/505; 430/507; 430/519; 430/521; 430/567; 430/957

[58] Field of Search ..... 430/567, 505, 507, 519, 430/521, 522, 496, 359, 957

[56] References Cited

U.S. PATENT DOCUMENTS

| | | | |
|---|---|---|---|
| 4,312,941 | 1/1982 | Scharf et al. | 430/510 |
| 4,391,884 | 7/1983 | Meyer et al. | 430/17 |
| 4,439,520 | 3/1984 | Kofron et al. | 430/434 |
| 4,740,454 | 4/1988 | Deguchi et al. | 430/567 |
| 4,746,600 | 5/1988 | Watanabe et al. | 430/505 |
| 4,833,069 | 5/1989 | Hamada et al. | 430/496 |
| 4,855,220 | 8/1989 | Szajewski | 430/505 |
| 4,956,269 | 9/1990 | Ikeda et al. | 430/505 |
| 5,190,851 | 3/1993 | Chari et al. | 430/505 |

OTHER PUBLICATIONS

Patent Abstracts of Japan, vol. 16, No. 5, p. 1295, Jan. 1992 (JP-A-03 226 729 Abstract).

Patent Abstracts of Japan, vol. 16, No. 5, p. 1295, Jan. 1992 (JP-A-03 226 731 Abstract).

*Primary Examiner*—Thorl Chea

*Attorney, Agent, or Firm*—Paul A. Leipold

[57] ABSTRACT

The invention relates to a color negative photographic recording material comprising a support bearing:

at least one photographic layer comprising a sensitized tabular grain silver halide emulsion having an average aspect ratio greater than about 8;

an image dye forming coupler;

at least one color dye forming development inhibitor releasing coupler; and at least one distributed dye that absorbs light in the region of the spectrum to which said sensitized tabular grain silver halide emulsion having an aspect ratio greater than about 8 is sensitized wherein;

the quantity of said at least one distributed dye is such as to reduce the sensitivity of the color record containing said sensitized tabular grain silver halide emulsion having an aspect ratio greater than about 8 by at least 20%; and the quantity of said at least one development inhibitor releasing compound being greater than about 0.07 mole percent relative to the total quantity of sensitized silver halide emulsion in said at least one photographic layer.

21 Claims, No Drawings

COLOR PHOTOGRAPHIC SILVER HALIDE NEGATIVE IMAGING PROCESS AND MATERIAL COMPRISING TABULAR SILVER HALIDE GRAINS, DEVELOPMENT INHIBITOR RELEASING COMPOUNDS AND DISTRIBUTED DYES

CROSS-REFERENCE TO RELATED APPLICATION

This is a continuation-in-part of our earlier filed application U.S. Ser. No. 869,675, filed on Apr. 16, 1992, now abandoned.

FIELD OF THE INVENTION

This invention relates to photographic materials and elements, specifically to materials and elements having tabular silver halide emulsion grains, DIR couplers, and distributed dyes in a specified spatial arrangement to enable improved sharpness.

BACKGROUND ART

Among the desirable properties of a photographic silver halide recording material is high sharpness. That is, the recording material should enable faithful reproduction and display of both coarse and fine details of the original scene. This combination of properties has proven difficult to achieve in practice.

A general description of the nature of this problem may be found in T. H. James, Ed., "The Theory of the Photographic Process," Macmillan, N.Y., 1977 and, in particular, at Chapter 20 of this text, pages 578–591, entitled "Optical Properties of the Photographic Emulsion" by J. Gasper and J. J. DePalma.

One method of improving sharpness, disclosed at U.S. Pat. No. 4,312,941 and at U.S. Pat. No. 4,391,884, involves the incorporation of a spatially fixed absorber dye in a film layer between the exposing light source and a layer comprising a conventional grain light sensitive silver halide emulsion. In these disclosures, the absorber dye is held spatially fixed either by means of a ballast group or by means of a mordanting material incorporated at a specified position in the film structure. Use of this spatial arrangement of absorber dye and emulsion reduces front-surface halation effects.

U.S. Pat. No. 4,439,520, inter alia, discloses the utility of sensitized high aspect ratio silver halide emulsions for use in light sensitive materials and processes. These high aspect ratio silver halide emulsions, herein known as tabular grain emulsions, differ from conventional grain emulsions in many characteristics. One differential characteristic is the relationship between the emulsion grain thickness and the emulsion grain equivalent circular diameter. Conventional grain emulsions tend to be isotropic in shape and, when incorporated in a film structure, tend to be randomly oriented within a particular layer. Tabular grain emulsions however, tend to be anisotropic in shape and, when incorporated in a film structure, tend to align such that their major axis parallels the plane of the film base. This degree of anisotropicity is know as the emulsion aspect ratio (AR), typically defined as the ratio of the emulsion grain equivalent circular diameter divided by the emulsion grain thickness. The ability to control emulsion grain thickness and alignment within a film structure can enable the realization of otherwise unattainable degrees of recording material performance.

The optical properties of photographic recording materials incorporating tabular grain emulsions are described in great detail at "*Research Disclosure*", No. 25330, May, 1985, as are methodologies of specifying particular arrangements of tabular grain emulsions within a film structure and of specifying particular tabular grain emulsion thicknesses so as to enable the attainment of specifically desired properties, such as speed or sharpness in underlying or overlying emulsion layers.

These methods may not prove to be wholly satisfactory. U.S. Pat. No. 4,740,454, for example, discloses that although high frequency sharpness may be attained by the appropriate choice of tabular grain emulsion thickness and placement, this can be at the cost of low frequency sharpness. The term "high frequency sharpness" generally relates to the appearance of fine detail in a scene reproduction, while the term "low frequency sharpness" generally relates to the appearance of clarity or "snap" in scene reproduction. It is understood that the terms "high frequency sharpness" and "low frequency sharpness" are qualitative in nature and that both image spatial frequency, expressed as cycles/mm in the film plane, and the image magnification employed in producing a reproduction must be taken into account when specifying such terms. This publication discloses that both high frequency and low frequency sharpness may be simultaneously improved by the incorporation of specific mercaptothiadiazole compounds in combination with tabular grain silver halide emulsions. This practice may not be wholly satisfactory since the incorporation of such silver ion ligands can lead to deleterious effects on film speed and film keeping properties.

In a related area, U.S. Pat. Nos. 4,746,600 and 4,855,220 disclose that unexpectedly large degrees of sharpness can be attained by combining spatially fixed absorber dyes and Development Inhibitor Releasing Compounds (DIR Compounds) in a photographic silver halide recording material. The spatially fixed absorber dye is positioned between an emulsion containing layer and the exposing light source. The materials described in these disclosures incorporate either conventional grain silver halide emulsions or low aspect ratio tabular grain silver halide emulsions. There is no indication of any dependence in film imaging performance on the thickness or spatial positioning of the light sensitive silver halide emulsion grains in these publications.

Again, in a related area, U.S. Pat. No. 4,833,069 discloses that large degrees of sharpness can be attained by simultaneously controlling imaging layer thickness to between 5 and 18 microns and incorporating large quantities, between 15 and 80 mol % of colored cyan dye-forming couplers, known also in the art as cyan dye-forming color masking couplers. This method may not be wholly satisfactory since the use of excessive quantities of color masking couplers can lead to inferior color rendition by over-correcting the color reproduction through excessive use of the masking function. Again, there is no indication of any dependence in film imaging performance on the thickness or spatial positioning of the light sensitive silver halide emulsion grains as described in this publication.

In yet another related area, U.S. Pat. No. 4,956,269 discloses that color reversal silver halide photographic materials incorporating tabular grain silver halide emulsions can show improved sharpness when the photographic layer incorporating the tabular grain silver halide emulsion also incorporates a quantity of absorber dye sufficient to reduce the speed of that layer by at least 20%, when the total imaging layer thickness is less than 16 microns and when the swell ratio of the film is greater than 1.25. The materials described in this disclosure incorporate intermediate aspect ratio (AR<9.0) tabular grain silver halide emulsions. The criticality of color dye forming Development Inhibitor Releasing (DIR) coupler presence and quantity is not addressed in this publication. As is generally known in the art, color reversal films are designed to operate in a best mode when developed according to a color reversal process while color negative films are designed to operate in a best mode when developed according to a color negative process. Color reversal processing entails a non-chromogenic "first development" step utilizing a potent silver halide solvent and a total grain developer, followed ultimately by a "second development" step producing total grain color development that employs a paraphenylene diamine developer, facilitated by unusually high developer solution pH. In profound contrast, a typical color negative film development step comprises a low silver halide solvent, grain surface developer that proceeds only to partial completion (typically 15–20% conversion).

It is the purpose of this color reversal material total development process to produce a unique density response as a function of the logarithm of exposure, known as a characteristic curve, with very high maximum density and very low minimum density over a relatively short imagewise exposure range so as to produce a high contrast positive image suitable for direct viewing. As a consequence of both the high range of density extreme and the smaller imaging range or latitude of the color reversal material, there is virtually no regime in the characteristic curve of constant contrast (or gamma) or straight-line curve shape that would linearly record scene luminance. Color negative materials differ graphically by producing long, imagewise straight-line characteristic curve segments at much lower contrast.

It is well appreciated by those skilled in the art that in order to achieve their unique characteristic curve responses, color reversal photographic recording materials comprise strikingly different varieties and quantities of photographic imaging constituents than color negative recording materials. In particular, materials intended for reversal processing typically contain much less silver halide and gelatin than color negative films. As a consequence largely of lower silver halide content, reversal color recording materials are thinner than color negative recording materials, as noted in Mitchell's "Photographic Science", John Wiley and Sons, 1984, at pages 194–195. Other substantial differences, totally neglecting the matters of silver halide grain composition, morphology, and spectrochemical sensitizations for vastly different development conditions, relate to the methods of color correction for faithful scene color reproduction. Materials intended for reversal processing and direct viewing do not comprise the colored masking couplers that are ubiquitous in the color negative recording materials of the commercial art due to their deleterious effect on the lightness and hue of scene highlights that the corrected reversal material would render.

Further, as discussed in Neblette's "Imaging Processes and Materials", 8th edition, 1988 at page 127, color reversal films generally include only colorless DIRs, which release development inhibitors as a result of a cross oxidation reaction with oxidized hydroquinone species present in the non-coupling first developer step employed in a color reversal process. This non-coupling step is generally absent from a color negative image forming process. Color dye forming DIR couplers are designed to not liberate development inhibitor in a non-coupling development step. For these reasons, the conditions and constraints relevant to a color reversal material designed to operate in a color reversal process are non-predictive of the performance of color negative silver halide photographic materials.

A color negative silver halide photographic recording material incorporating conventional grain silver halide emulsions and a quantity of distributed dye sufficient to reduce the speed of a color record by about 50% has been commercially available for many years. Additionally, it has been common practice in the photographic art to commercially provide silver halide photographic recording materials incorporating conventional grain and/or tabular grain silver halide emulsions in combination with soluble dyes sufficient to reduce the speed of a color record by about 10% for purposes related to ease of manufacture. Likewise, color negative silver halide photographic materials incorporating high aspect ratio tabular grain silver halide emulsion with an average grain thickness of circa 0.11 and 0.14 microns in an intermediately positioned layer have been commercially available for many years.

PROBLEM TO BE SOLVED BY THE INVENTION

Despite all of this effort, fully adequate degrees of sharpness have not been attained in silver halide photographic materials comprising high aspect ratio tabular grain emulsions. There is a continuing need to provide a silver halide photographic recording material incorporating high aspect ratio tabular grain silver halide emulsions showing excellent sharpness performance.

SUMMARY OF INVENTION

An object of the invention is to provide improved images with high aspect ratio tabular grains.

Another object of the invention is to provide photographic pictures with more snap.

A further object of the invention is to provide images with improved viewer perceived color rendition.

An additional object of this invention is to provide a process for forming such improved images.

The objects of this invention generally are provided by a color negative photographic recording material comprising a support bearing:

- at least one photographic layer comprising a sensitized tabular grain silver halide emulsion having an average aspect ratio greater than about 8;
- an image dye forming coupler;
- at least one color dye forming development inhibitor releasing coupler;
- at least one distributed dye that absorbs light in the region of the spectrum to which said sensitized tabular grain silver halide emulsion having an aspect ratio greater than about 8 is sensitized;
- the quantity of said at least one distributed dye being such as to reduce the sensitivity of the color record containing said sensitized tabular grain silver halide emulsion having an aspect ratio greater than about 8 by at least 20%; and
- the quantity of all development inhibitor releasing compounds being greater than about 0.07 mole percent relative to the total quantity of sensitized silver halide emulsion.

The objects of this invention are additionally achieved by a process of forming a color negative image comprising providing an imagewise exposed color photographic recording material comprising a support bearing:

at least one photographic layer comprising a sensitized tabular grain silver halide emulsion having an average aspect ratio greater than about 8;

an image dye forming coupler;

at least one color dye forming development inhibitor releasing coupler;

at least one distributed dye that absorbs light in the region of the spectrum to which said sensitized tabular grain silver halide emulsion having an aspect ratio greater than about 8 is sensitized;

the quantity of said at least one distributed dye being such as to reduce the sensitivity of the color record containing said sensitized tabular grain silver halide emulsion having an aspect ratio greater than about 8 by at least 20%; and the quantity of all development inhibitor releasing compounds being greater than about 0.07 mole percent relative to the total quantity of sensitized silver halide emulsion;

contacting said recording material with color developing agent to reduce developable silver halide and oxidize said color developing agent, the oxidized color developing agent in turn reacting with said color dye forming development inhibitor releasing coupler to yield a dye;

forming a color negative image.

In a preferred embodiment of this invention, a color negative photographic material is formed wherein the photographic material comprises at least three photographic elements each said element being sensitized to different regions of the spectrum;

the most light sensitive layer of at least one photographic element comprises a sensitized high aspect ratio tabular grain silver halide emulsion; and said distributed dye absorbs light in the region of the spectrum to which said high aspect ratio tabular grain silver halide emulsion is sensitized.

Another preferred embodiment of the invention is provided by a color negative photographic recording material as described above wherein more than one of the most sensitive photographic layers comprise sensitized high aspect ratio tabular grain silver halide emulsions; and wherein the photographic material comprises one or more distinct distributed dyes chosen to absorb light in the region of the spectrum to which at least one of said high aspect ratio tabular grain silver halide emulsions is sensitized.

In an especially preferred embodiment, the invention provides photographic materials wherein the majority of the photographic layers comprise a sensitized high aspect ratio tabular grain silver halide emulsion.

ADVANTAGEOUS EFFECT OF THE INVENTION

The invention has numerous advantages over the prior art. The invention allows the use of high aspect ratio tabular grains to achieve uniquely high and improved sharpness. The use of the distributed dyes of the invention that may move between layers during formation of the photographic element or its later storage allows the introduction of the absorber dye into a single location of the multilayer photographic recording material during manufacture, simplifying this labor intensive process. The improved sharpness obtained by the invention surprisingly allows the use of large tabular grains that are very fast even when their sensitivity is decreased by greater than 20 percent by the use of the absorbing dye technique of the invention. The invention allows almost full advantage to be taken of the high speed of tabular grains with markedly improved sharpness. These and other advantages will be apparent from the description below. It is surprising that there is an improvement in the performance of tabular emulsions when a relatively large amount of absorbing dye is utilized in photographic elements, as this effect is not apparent with three dimensional silver halide grains or when lesser dye amounts are used.

DETAILED DESCRIPTION OF THE INVENTION

The materials referred to as distributed dyes are generally soluble and may migrate between layers during application of the photographic material coating liquid composition to cover a support to form photographic layers. They also may migrate during or after drying of the gelatin. As they have this property, they may be applied in the photographic element in any layer, either those containing emulsions or inner layers between emulsion layers or in the layers above the emulsion layers. In this application, the terms above, "top" and "surface" will refer to the portion of the photographic element that is directed towards the exposure source during use. In contrast, the terms "bottom" and "lower" will refer to those layers of the photographic element that are closer to the substrate on which the photosensitive layers lie and further from the source of exposure. In a photographic material the "most sensitive layer" in an element is the layer that comprises the silver halide most sensitive to the spectral region to which the element as a whole is sensitized.

The distributed dye to be effective is matched such that its absorbance is for the same color light to which the particular high aspect ratio tabular emulsion is sensitized. For instance, if the high aspect ratio tabular emulsion is sensitized to blue and, therefore, is in the yellow layer, then the distributed dye is also absorbing of blue light. Distributed dyes intended to improve tabular emulsions in the cyan layer would be absorbing of red light.

The invention of a distributed dye present in an amount sufficient to reduce sensitivity of said silver halide at least 20 percent may also be described as having sufficient dye to reduce the exposure of the silver halide by at least 20 percent. Further, the photographic elements of the invention also may contain particularly preferred tabular silver halide grains for a particular thickness and diameter. It is also possible that the distributed dye of the invention may be combined with a spatially fixed dye that does not move from the layer in which it is present during application of the coating liquid compositions of the photographic element. The relationship between the distributed dye and the spatially fixed dye may be adjusted to achieve a particularly desired effect and sharpness. For instance, the spatially fixed dye could be utilized for absorption of a particular portion of a visible spectrum while the distributed dye could be utilized for absorbing a different portion of the visible spectrum.

The photographic materials of this invention can be either single color or multicolor materials. Multicolor materials typically contain dye image-forming elements sensitive to each of the three primary regions of the spectrum. In some cases the multicolor material may contain elements sensitive to other regions of the spectrum or to more than three regions of the spectrum. Each element can be comprised of a single emulsion layer or of multiple emulsion layers sensitive to a given region of the spectrum. The layers of the material, including the layers of the image-forming elements, can be arranged in various orders as known in the art.

As used herein, the terms "element", "color element", "record" and "color record" refer to one or more silver halide containing layers sensitive to the same wavelength region of the electromagnetic spectrum. The region from about 400 nm to 500 nm is generally referred to as blue light, the region from about 500 nm to 600 nm as green light and the region from about 600 nm to 700 nm as red light.

A typical multicolor photographic material comprises a support bearing a cyan dye image-forming element comprising at least one red-sensitive silver halide emulsion layer having associated therewith at least one cyan dye-forming coupler, a magenta image forming element comprising at least one green-sensitive silver halide emulsion layer having at least one magenta dye-forming coupler and a yellow dye image-forming element comprising at least one blue-sensitive silver halide emulsion layer having associated therewith at least one yellow dye-forming coupler. In some instances it may be advantageous to employ other pairings of silver halide emulsion sensitivity and dye image-forming couplers, as in the pairing of an infra-red sensitized silver halide emulsion with a magenta dye-forming coupler or in the pairing of a blue-green sensitized emulsion with a coupler enabling minus-cyan dye formation. The material can contain additional layers, such as filter layers, interlayers, overcoat layers, subbing layers, and the like. The layers of the material above the support typically have a total thickness of between about 5 and 30 microns. The total silver content of the material is typically between 1 and 10 grams per $m^2$.

It is generally preferred to minimize the thickness of the photographic material above the support so as to improve sharpness and improve access of processing solutions to the components of the material. For this reason, overall thicknesses of less than about 25 microns are preferred and thicknesses of less than about 20 microns are even more preferred. It is additionally preferred to minimize the total thicknesses of the color forming layers as measured from the portion of a light sensitive layer closest to the support to the portion of a light sensitive layer furthest from the support. Total color forming layer thicknesses of between about 25 and 3 microns are generally useful, while thicknesses between about 20 and about 5 microns are preferred, and thicknesses between about 18 and 8 microns are most preferred. These lowered thicknesses can be especially enabled at manufacture by use of surfactants, polymers, and other coatings aids as known in the art so as to control surface tension and viscosity. Other polymeric materials, humectants, and gelatin plasticizers are known to improve hardening leading to better physical integrity and reduced sensitometric variability over time. Both sharpness and ease of processing may be further improved by minimizing the quantity of incorporated silver in the element. Total silver of less than about 7 grams per square meter is preferred and total silver of less than about 5 grams per square meter is even more preferred. Sharpness in color images is further improved by complete removal of silver and silver halide from the element on processing. Since more highly swellable elements enable better access of components of processing solutions to the elements of this invention, swell ratios above 1.25 are preferred, with swell ratios of between 1.4 and 6 being more preferred and swell ratios of between 1.7 and 3 being most preferred. The balance of total thickness, imaging layer thickness, total silver and swell ratio most suitable for an element intended for a specific purpose being readily derived from the image structure, color reproduction, sensitivity and physical integrity and photographic resistance to pressure required for that purpose as known in the art. Use of polymeric materials and gelatin levels as known in the art to further control these photographic and physical properties is recommended.

The photographic materials of this invention can have any photographic sensitivity known in the art. Camera films with a sensitivity of between ISO 25 and ISO 3200 are well know and useful in the practice of this invention while sensitivities between ISO 50 and ISO 1600 are preferred, and sensitivities between ISO 64 and ISO 1000 are more preferred. Use of the highest possible sensitivity while maintaining other useful properties is generally preferred in films designed for general use, while the lower sensitivities are more preferred in those situations demanding excellent image structure.

The sensitized high aspect ratio tabular grain silver halide emulsions useful in this invention are like those disclosed by Kofron et alia in U.S. Pat. No. 4,439,520 and in the additional references cited below. These high aspect ratio tabular grain silver halide emulsions and other emulsions useful in the practice of this invention can be characterized by geometric relationships, specifically the Aspect Ratio and the Tabularity. The Aspect Ratio (AR) and the Tabularity (T) are defined by the following equations:

$$AR = \frac{\text{Equivalent Circular Diameter}}{\text{Thickness}}$$

$$T = \frac{\text{Equivalent Circular Diameter}}{\text{Thickness} \times \text{Thickness}}$$

where the equivalent circular diameter and the thickness of the grains, measured using methods commonly known in the art, are expressed in units of microns.

High Aspect Ratio Tabular Grain Emulsions useful in this invention have an average AR greater than 8 and are most preferred to have an AR>10. These useful emulsions additionally can be characterized in that their average Tabularity is generally greater than 25 and they have a preferred Tabularity of greater than 50 for best sharpness while having good speed.

Examples illustrating the preparation of such useful emulsions will be shown below.

In the following discussion of suitable compounds for use in the material of this invention, reference will be made to *Research Disclosure*, December 1989, Item 308119, published by Kenneth Mason Publications, Ltd., The Old Harbourmaster's 8 North Street, Emsworth, Hampshire P010 7DD, ENGLAND, the disclosure of which are incorporated herein by reference. This publication will be identified hereafter by the tern "Research Disclosure".

The silver halide emulsions employed in the material of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226; Daubendiek et al U.S. Pat. No. 4,414,310; Wey U.S. Pat. No. 4,399,215; Solberg et al U.S. Pat. No. 4,433,048; Mignot U.S. Pat. No. 4,386,156; Evans et al U.S. Pat. No. 4,504,570; Maskasky U.S. Pat. No. 4,400,463; Wey et al U.S. Pat. No. 4,414,306; Maskasky U.S. Pat. Nos. 4,435,501 and 4,643,966, and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in G. B. Patent 1,027,146; Japanese 54/48521; U.S. Pat. Nos. 4,379,837; 4,444,877; 4,665,012; 4,686,178; 4,565,778; 4,728,602; 4,668,614; 4,636,461; EP 264,954; and U.S. Ser. No. 842,683 of Antoniades et al filed Feb. 27, 1992. Also suitable for the invention are tabular silver chloride grains such as disclosed in U.S. Pat. Nos. 5,176,991; 5,176,992; 5,178,998; 5,183,732; and 5,185,239 and European Patent Publication 0 534 395. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines, and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure*, Item 308119, cited above, Section IV.

The spatially fixed dyes useful in combination with the distributed dyes of this invention are well known in the art. These spatially fixed dyes are also known as non-diffusible dyes and as anti-halation dyes. Typical examples of spatially fixed dyes, their preparation and methods of incorporation in photographic materials are disclosed in U.S. Pat. Nos. 4,855,220; 4,756,600; and 4,956,269, as well as by commercially available materials. Other examples of spatially fixed dye are disclosed at Section VIII of Research Disclosure.

The dye absorbs light in the region of the spectrum to which the high aspect ratio tabular grain silver halide layer of the invention is sensitized. While the dye will generally absorb light primarily only in that region, dyes that absorb light in other regions of the spectrum, as well as the region to which the silver halide is sensitized, are also included within the scope of the invention. A simple test as to whether the spatially fixed dye is within the scope of the invention is if the speed of the silver halide layer of the invention is less when the dye is present than when it is not, then the dye is within the scope of the invention.

By spatially fixed, it is meant that little or none of the dye will migrate out of the layer in which it has been incorporated before the photographic material has been processed.

These dyes may be ballasted to render them non-diffusible or they may be intrinsically diffusible but rendered non-diffusible by use of organic mordanting materials, such as charged or uncharged polymeric matrixes, or rendered non-diffusible by adhesion to inorganic solids such as silver halide, or organic solids all as known in the art. Alternatively, these dyes may be incorporated in polymeric latexes. These dyes may additionally be covalently bound to polymeric materials.

These dyes may retain their color after processing or may change in color, be decolorized or partially or completely removed from the photographic material during processing. For ease of direct viewing or optical printing it may be preferred that the dyes be removed from the material or be rendered non-absorbing in the visible region during or after processing. During photographic development (generally in high pH, e.g. 9 or above, sulfite containing processing solution), bleaching (in iron containing or persulfate or other peroxy containing solutions at lower pH, e.g. 7 or below) or fixing, the dye may be decolorized or removed from the material. In photographic materials where the image may be electronically scanned or digitally manipulated, the material may or may not retain some degree of coloration depending on the intended use.

The spatially fixed dye may be a diffusible acidic dye that is rendered non-diffusible by incorporating a base group-containing polymeric mordant for the dye at a specified position in the photographic material. Such dyes preferably have a sulfo- or carboxy-group. Useful dyes can be acidic dyes of the azo type, the triphenylmethane type, the anthroquinone type, the styryl type, the oxanol type, the arylidene type, the merocyanine type, and others known in the art. Polymer mordants are well known in the art and are described, for example, in U.S. Pat. Nos. 2,548,564; 2,675,316; 2,882,156; and 3,706,563 as well as in *Research Disclosure*, Item 308119, Section VIII.

The spatially fixed dye may also be a solid particle dispersion of a loaded polymer latex of a dye that is insoluble at coating pH but soluble at processing pH's as described in U.S. Pat. No. 4,855,211—Factor et al.

Additionally, the dye may be a colored image dye-forming coupler as disclosed in *Research Disclosure*. Item 308119, Section VII. The color of such a dye may be changed during processing. The dye may be a preformed image coupler dye which would generally remain in the material during processing. The dye may also be a spectral sensitizing dye immobilized by adsorption to chemically unsensitized silver halide. Such a dye would generally be removed from the material during the bleaching or fixing step.

It is preferred that such spatially fixed dyes be positioned closer to the image exposure source than the photographic layer comprising a high aspect ratio tabular grain silver halide emulsion sensitized to a region of the spectrum where such dyes absorb light.

Examples of useful spatially fixed dyes include the dye materials described in the photographic examples illustrating the practice of this invention, in the disclosures cited earlier and include the structures shown below.

CM-1

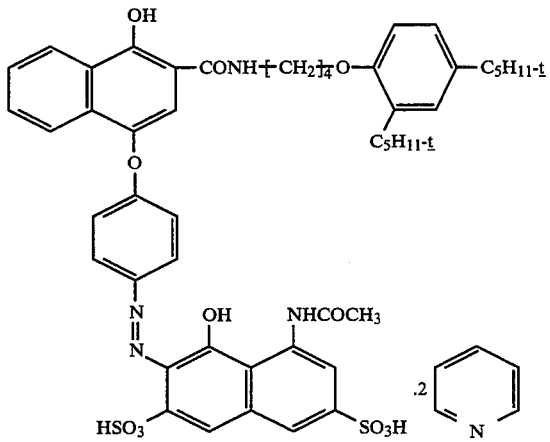

MM-1

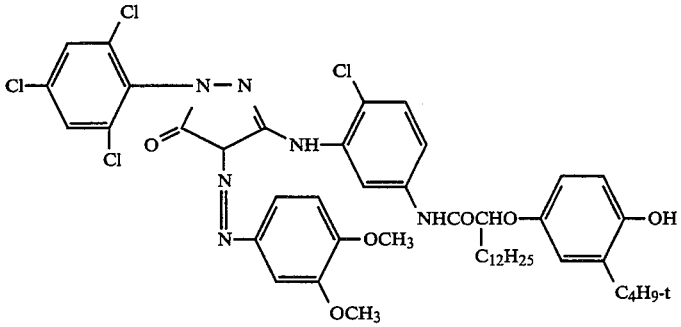

MM-2

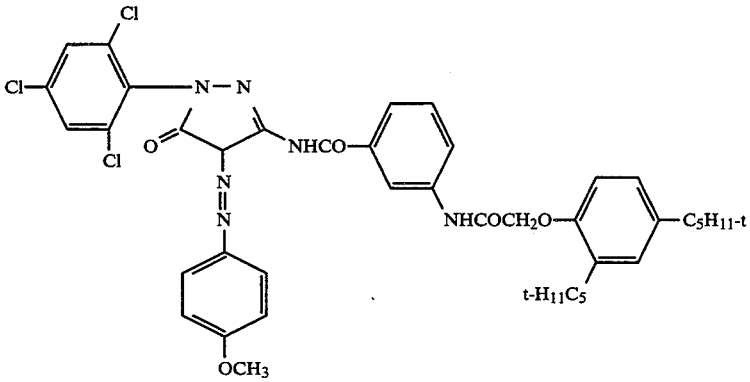

-continued
CD-1
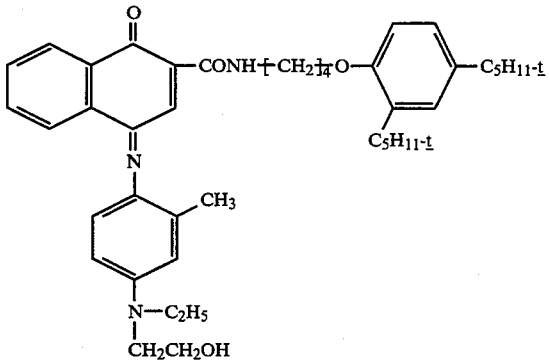
MD-1
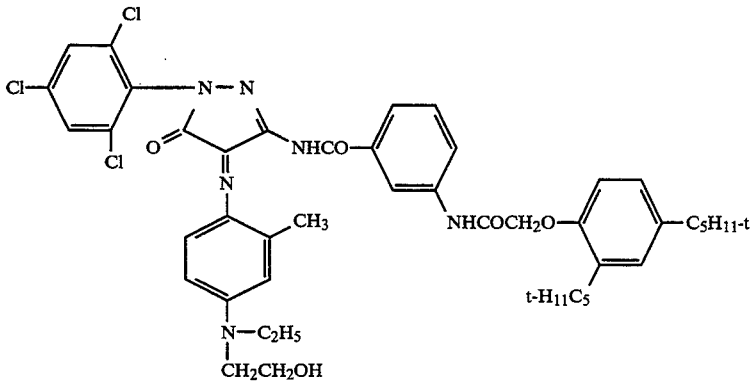
YD-1
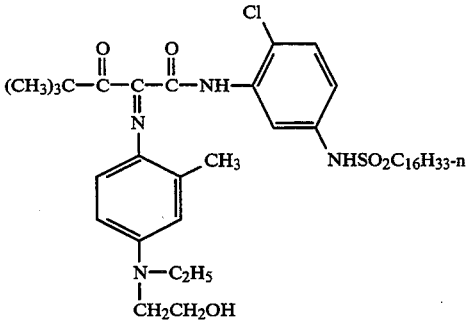
YD-2
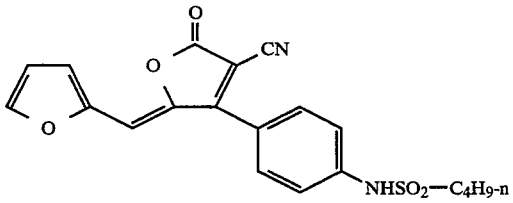
SOL-M1
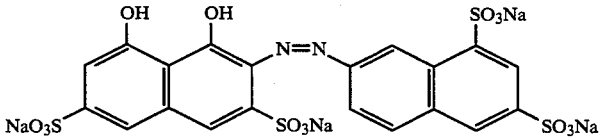
SOL-C1
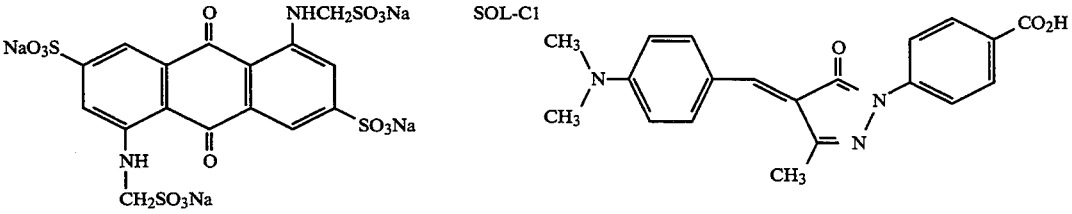
SOL-Y1
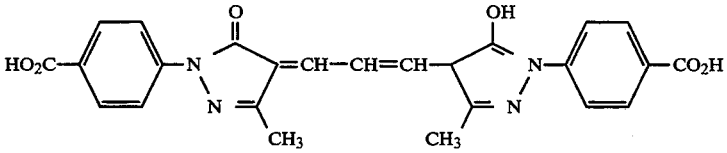

-continued
CD-2
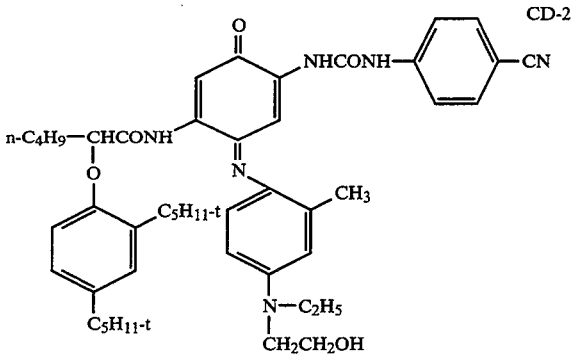
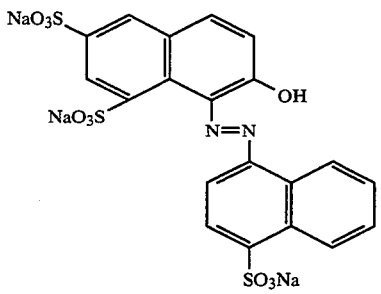
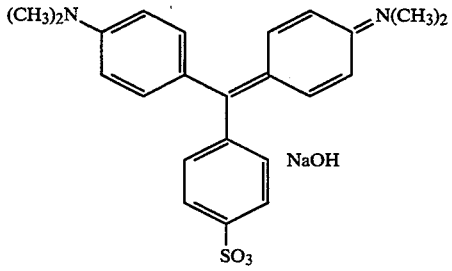
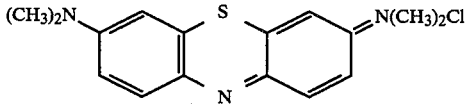
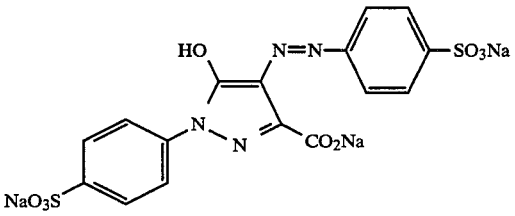
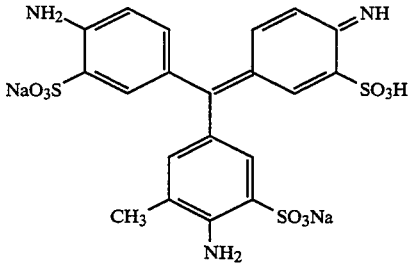
Other useful dye structures include but are not limited to
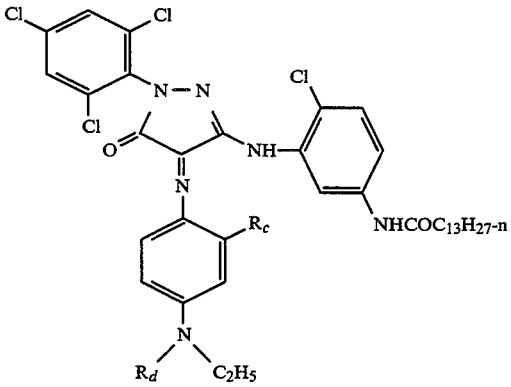
where $R_c$=—H or —$CH_3$ and $R_d$=—H; —$CH_2CH_2OH$; —$CH_2CH_3$; or —$CH_2CH_2$—$NHSO_2CH_3$.
Examples of polymer mordants useful in combination with diffusible acidic dyes in elements of the present invention include the following:
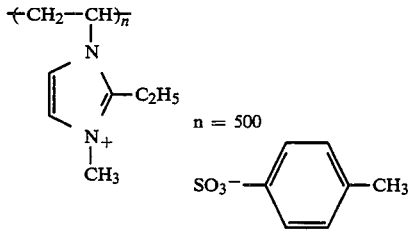
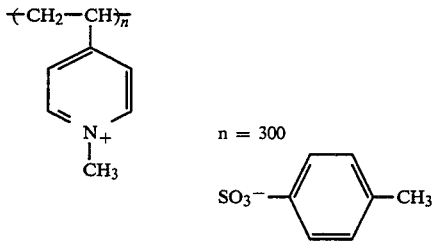
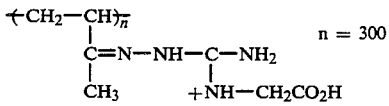

-continued

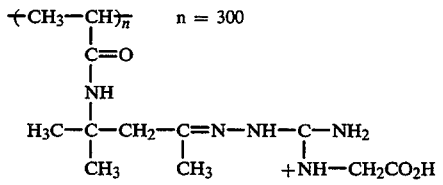

n = 300

Alternatively, it may be desirable to employ anionically charged polymers in combination with diffusible cationic dyes.

The distributed dyes of this invention may suitably be any of the soluble dyes known in the art as disclosed commercially, in U.S. Pat. Nos. 4,855,220; 4,756,600; and 4,956,269, or at Section VIII of *Research Disclosure* cited earlier.

By distributed, it is meant that quantities of the dye (or a dye combination) which absorb light in the region of the spectrum to which the high aspect ratio tabular grain silver halide layer of the invention is sensitized are present in several of the layers of the photographic material before the exposure of said material.

It is preferred that such distributed dyes be positioned both closer to, coincident with and further from the image exposure source than the photographic layer comprising a high aspect ratio tabular grain silver halide emulsion sensitized to a region of the spectrum where such dyes absorb light.

The preferred soluble dyes generally are diffusible and have the property of distributing within the structure of a photographic material to a greater or lesser extent during a wet coating procedure or during a subsequent curing or storage procedure. Alternatively, these dyes may be added to a photographic material in a subsequent coating, imbibing or like procedure as known in the art. These soluble dyes may additionally be caused to distribute in specific patterns within a photographic material by the addition of mordanting materials in appropriate quantities and positions within the structure of the photographic material. The mordanting material may be the charged or uncharged polymeric materials described earlier. Alternatively, the distribution of the dye may be controlled by the quantity and disposition of hydrophobic organic materials such as couplers or coupler solvents or absorbent charged or uncharged inorganic materials such as silver halide and the like within the coating structure.

Alternatively, but less preferred, non-diffusible dyes may be employed and evenly distributed in the photographic material. These may include any of the non-diffusible dyes previously described. When non-diffusible dyes are employed they may be distributed within a photographic material by addition of a portion of each to the photographic layers as they are coated.

The dye absorbs light in the region of the spectrum to which the high aspect ratio tabular grain silver halide layer of the invention is sensitized. While the dye will generally absorb light primarily only in that region, dyes that absorb light in other regions of the spectrum as well as the region to which the silver halide is sensitized are also included within the scope of the invention. A simple test as to whether the distributed dye is within the scope of the invention is if the speed of the silver halide layer of the invention is reduced by at least 20% by the presence of the distributed dye, then the distributed dye is within the scope of the invention. Sensitivity reductions of about 25% or more are preferred with sensitivity reductions of about 35%, 50%, 75% or of up to 95% contemplated. When both distributed and spatially fixed absorber dyes are employed in combination, sensitivity reductions of 20% or more based on the presence of both dyes are specifically contemplated.

These dyes may retain their color after processing or may change in color, be decolorized or partially or completely removed from the photographic material during processing. For ease of direct viewing or optical printing it may be preferred that the dyes be removed from the film or rendered non-absorbing in the visible region during or after processing. During photographic development (generally in high pH, e.g., 9 or above, sulfite containing processing solution), bleaching (in iron containing or persulfate or other peroxy containing solutions at lower pH, e.g., 7 or below) or fixing, the dye may be decolorized or removed from the material. In photographic materials where the image may be electronically scanned or digitally manipulated, the material may or may not retain some degree of coloration depending on the intended use.

The distributed dye may be a diffusible acidic dye. Such dyes preferably have a sulfo- or carboxy-group. Useful dyes can be acidic dyes of the azo type, the triphenylmethane type, the anthroquinone type, the styryl type, the oxanol type, the arylidene type, the merocyanine type, and others known in the art.

Specific examples of distributed dyes are shown in the literature cited earlier, in the discussion of spatially fixed dyes and in the examples illustrating the practice of the invention.

The thicknesses of the silver halide emulsions employed in this invention may be advantageously adjusted for the purposes of improving film performance according to principles described in *Research Disclosure*, May, 1985, Item 25330. This disclosure teaches, by extrapolation from the optical properties of silver bromide sheet crystals, that the thicknesses of silver halide emulsions incorporated in specific photographic layers and sensitized to one spectral region may be chosen to enable either improved speed or improved sharpness behavior in other photographic layers incorporating silver halide emulsions sensitized to different regions of the spectrum. These improvements are said to occur because the light transmission and reflection properties of the silver halide emulsions are controlled in large part by their grain thicknesses. Further discussion on the relationship between the thickness of silver halide crystals and their reflectance properties can be found in Optics, by J. M. Klein, John Wiley & Sons, New York, 1960, pages 582 to 585. These disclosures make no teaching about the relationship between the thickness of a silver halide emulsion sensitized to a particular region of the spectrum and the sharpness behavior of a photographic layer or element using such an emulsion.

It has now been found that the sharpness of a photographic element can be unexpectedly improved by setting the thickness of the sensitized high aspect ratio tabular grain emulsion utilized in a most sensitive layer of that element such that the reflection in the region of the spectrum to which that emulsion is sensitized is at a minimum.

It is preferred that the most sensitive layer comprising a high aspect ratio tabular grain silver halide emulsion in which the thickness of said emulsion is chosen so as to minimize reflectance in the region of the spectrum to which the emulsion is sensitized be further from the image exposure source than another most sensitive layer of an element which comprises a high aspect ratio tabular grain emulsion sensitized to a different region of the spectrum.

Thus, to improve sharpness in a blue sensitized element which incorporates a blue sensitized emulsion with a peak sensitivity at about 450 nm used in a most blue sensitive layer, an emulsion grain thickness of between 0.08 and 0.10 microns is preferred. An emulsion grain thickness close to the center of this range, i.e., 0.09 microns is more preferred. An emulsion grain thickness of between 0.19 and 0.21 microns can also be used to advantage in this instance.

In a like manner, to improve sharpness in a green sensitized element which incorporates a green sensitized emulsion with a peak sensitivity at about 550 nm used in a most green sensitive layer, an emulsion grain thickness of between 0.11 and 0.13 microns is preferred. An emulsion grain thickness close to the center of this range, i.e., 0.12 microns is more preferred. An emulsion grain thickness of between 0.23 and 0.25 microns can also be used to advantage in this instance.

In a similar vein, to improve sharpness in a red sensitized element which incorporates a red sensitized emulsion with a peak sensitivity at about 650 nm used in a most red sensitive layer, an emulsion grain thickness of between 0.14 and 0.17 microns is preferred. An emulsion grain thickness close to the center of this range, i.e., 0.15 microns is more preferred. An emulsion grain thickness of between 0.28 and 0.30 microns can also be used to advantage in this instance.

It is straightfoward to choose emulsion grain thicknesses to improve the sharpness behavior of emulsions sensitized to other regions of the spectrum or with peak sensitivity at different wavelengths according to this invention by following the disclosed pattern.

Thus, for an infrared sensitized emulsion with peak sensitivity at 750 nm, an emulsion grain thickness of between 0.17 and 0.19 microns would be chosen, while for a blue-green sensitized emulsion with peak sensitivity at 500 nm, an emulsion grain thickness of between 0.10 and 0.12 microns would be chosen.

When a photographic element is comprised of more than one photographic layer, it is additionally preferred that the thickness of the silver halide emulsions used in such layers be also chosen so as to minimize reflection in the region of the spectrum to which the emulsion is sensitized.

Even when the thickness of a silver halide emulsion employed in a most sensitive layer is not chosen according to this pattern, it may be useful to choose the thickness of an emulsion used in a less sensitive layer according to the disclosed pattern.

It has also been found that both the speed and sharpness of a first photographic element wherein the most light sensitive layer of that first element comprises a high aspect ratio silver halide emulsion whose thickness has been chosen so as to minimize reflection in the region of the spectrum to which that emulsion is sensitized can be unexpectedly and simultaneously improved when the photographic material additionally comprises a second photographic element sensitized to a different region of the spectrum wherein the most light sensitive layer of said second element is positioned closer to the image exposure source than the most light sensitive layer of said first element and the most light sensitive layer of said second element additionally comprises a high aspect ratio tabular grain emulsion whose thickness is also chosen to minimize the reflectance in the region of the spectrum to which the first element is sensitive.

Thus, to improve speed and sharpness in a red light sensitive element which comprises a high aspect ratio tabular grain silver halide emulsion with a peak sensitivity at about 650 nm used in a most red sensitive layer, in a photographic material comprising a most green light sensitive layer positioned closer to an image exposure source than the most red light sensitive layer, it is preferred to choose the thickness of the sensitized high aspect ratio tabular grain emulsions employed in both of said most sensitive layers to be between 0.14 and 0.17 microns. An emulsion grain thickness close to the center of this range, 0.15 microns is more preferred. An emulsion grain thickness of between 0.28 and 0.30 microns can also be used to advantage in this instance.

Likewise, to improve speed and sharpness in a red light sensitive element which comprises a high aspect ratio tabular grain silver halide emulsion with a peak sensitivity at about 650 nm used in a most red sensitive layer, in a photographic material comprising a most blue light sensitive layer positioned closer to an image exposure source than the most red light sensitive layer, it is preferred to choose the thickness of the sensitized high aspect ratio tabular grain emulsions employed in both of said most sensitive layers to be between 0.14 and 0.17 microns. An emulsion grain thickness close to the center of this range, 0.15 microns is more preferred. An emulsion grain thickness of between 0.28 and 0.30 microns can also be used to advantage in this instance.

In a similar vein, to improve speed and sharpness in a green light sensitive element which comprises a high aspect ratio tabular grain silver halide emulsion with a peak sensitivity at about 550 nm used in a most green sensitive layer, in a photographic material comprising a most red light sensitive layer positioned closer to an image exposure source than the most green light sensitive layer, it is preferred to choose the thickness of the sensitized high aspect ratio tabular grain emulsions employed in both of said most sensitive layers to be between 0.11 and 0.13 microns. An emulsion grain thickness close to the center of this range, 0.12 microns is more preferred. An emulsion grain thickness of between 0.23 and 0.25 microns can also be used to advantage in this instance.

Other combinations of two or more high aspect ratio tabular grain emulsions sensitized to different regions of the spectrum and employed in different most sensitive layers of different elements can be obviously derived based on the above disclosure and pattern of preferred thicknesses.

It is especially preferred in a photographic material sensitive to three regions of the spectrum to employ sensitized high aspect ratio tabular grain emulsions whose thicknesses are chosen so as to minimize the reflectance in the region of the spectrum to which the emulsion employed in the most sensitive layer positioned furthest from the image source of all of the most sensitive layers is sensitized.

It is straightfoward to choose emulsion grain thicknesses to improve the sharpness behavior of emulsions sensitized to other regions of the spectrum or with peak sensitivity at different wavelengths according to this invention by following the disclosed pattern.

Thus, for an infrared sensitized emulsion with peak sensitivity at 750 nm, an emulsion grain thickness of between 0.17 and 0.19 microns would be chosen, while for a blue-green sensitized emulsion with peak sensitivity at 500 nm, an emulsion grain thickness of between 0.10 and 0.12 microns would be chosen.

When a photographic element is comprised of more than one photographic layer, it is additionally preferred that the thickness of the silver halide emulsions used in such layers be also chosen so as to minimize reflection in the region of the spectrum to which the emulsion is sensitized.

Even when the thickness of a silver halide emulsion employed in a most sensitive layer is not chosen according to this pattern, it may be useful to choose the thickness of an emulsion used in a less sensitive layer according to the disclosed pattern.

The photographic materials of this invention may advantageously comprise Development Inhibitor Releasing Compounds, also called DIR compounds as known in the art. Typical examples of DIR compounds, their preparation and methods of incorporation in photographic materials are disclosed in U.S. Pat. Nos. 4,855,220 and 4,756,600 as well as by commercially available materials. Other examples of useful DIR compounds are disclosed at Section VIIF of *Research Disclosure.*

These DIR compounds may be incorporated in the same layer as the high aspect ratio emulsions of this invention, in reactive association with this layer or in a different layer of the photographic material, all as known in the art.

These DIR compounds may be among those classified as "diffusible," meaning that they enable release of a highly transportable inhibitor moiety or they may be classified as "non-diffusible" meaning that they enable release of a less transportable inhibitor moiety. The DIR compounds may comprise a timing or linking group as known in the art.

The inhibitor moiety of the DIR compound may be unchanged as the result of exposure to photographic processing solution. However, the inhibitor moiety may change in structure and effect in the manner disclosed in U. K. Patent No. 2,099,167; European Patent Application 167,168; Japanese Kokai 205150/83 or U.S. Pat. No. 4,782,012 as the result of photographic processing.

The development inhibitor can be attached to any moiety from which it can be released during the development step. Typically, the compound contains a carrier group from which the inhibitor is released either directly or from an intervening timing or linking group which is first released from the carrier group.

Carrier groups useful in DIR compounds include various known groups from which the development inhibitor can be released by a variety of mechanisms. Representative carrier groups are described, for example, in U.S. Pat. No. 3,227,550 and Canadian Patent 602,607 (release by chromogenic coupling); U.S. Pat. Nos. 3,443,939 and 3,443,940 (release by intramolecular ring closure); U.S. Pat. Nos. 3,628,952; 3,698,987; 3,725,062; 3,728,113; 3,844,785; 4,053,312; 4,055,428 and 4,076,529 (release after oxidation of carrier); U.S. Pat. Nos. 3,980,479; and 4,199,335 and U.K. Patents 1,464,104 and 1,464,105 (release unless carrier is oxidized); and U.S. Pat. No. 4,139,379 (release after reduction of carrier).

The timing or linking group of the DIR compound can be any organic linking group which will serve to join the development inhibitor moiety to the carrier moiety and which, after its release from the carrier, will be cleaved from the development inhibitor moiety. Such groups are described, e.g., in U.S. Pat. Nos. 4,248,962; 4,409,323; and 4,861,701.

When the DIR compound is a developing agent of the type disclosed, for example, at U.S. Pat. No. 3,379,529, the development inhibitor is imagewise released as a result of silver halide development by the developing agent, optionally in the presence of an auxiliary developing agent.

When the DIR compound is a hydroquinone compound of the type described, for example, in European Patent Application 0,167,168, the developement inhibitor is imagewise released by a redox reaction in the presence of an oxidized developing agent.

When the DIR compound is a coupler, the development inhibitor group is imagewise released by a coupling reaction between the coupler and oxidized color developing agent. The carrier moiety can be any coupler moiety employed in conventional color photographic couplers which yields either colored or a colorless reaction product. Especially preferred are coupler compounds, including both dye forming couplers and so called "universal" couplers which do not form a permanent colored species on reaction with oxidized silver halide developing agent.

For a DIR compound to be in reactive association with a light sensitive layer means that development in that layer causes the DIR compound to release a development inhibitor or precursor thereof.

For a DIR coupler to be in reactive association with a light sensitive layer means that color development in that layer results in production of an oxidized form of the color developing agent, the oxidized form of the color developing agent in turn reacts with the DIR coupler in a coupling reaction which results in liberation of a development inhibitor or precursor thereof from the DIR coupler.

The DIR compounds can be employed in any quantity known in the art. Typically, total quantities of all DIR compounds greater than about 0.01 mole percent relative to all sensitized silver halide, and more commonly quantities greater than about 0.07 mol percent are employed. It is preferred to employ between about 0.07 and 10 mole percent of total DIR compound total to sensitized silver halide, more preferred to employ between 0.1 and 5 mole percent and most preferred to employ between about 0.15 and 4 mole percent relative to all sensitized silver halide.

When the DIR compounds are dye-forming couplers, they may be incorporated in reactive association with complementary color sensitized silver halide emulsions, as for example a cyan dye-forming DIR coupler with a red sensitized emulsion or in a mixed mode, as for example a yellow dye-forming DIR coupler with a green sensitized emulsion, all as known in the art.

The DIR compounds may also be incorporated in reactive association with bleach accelerator releasing couplers as disclosed in U.S. Pat. Nos. 4,912,024, and 5,135,839 and in U.S. application Ser. No. 563,725 filed Aug. 8, 1990.

Specific DIR compounds useful in the practice of this invention are disclosed in the above cited references, in commercial use and in the examples demonstrating the practice of this invention which follow. The structures of other useful DIR compounds are shown below.

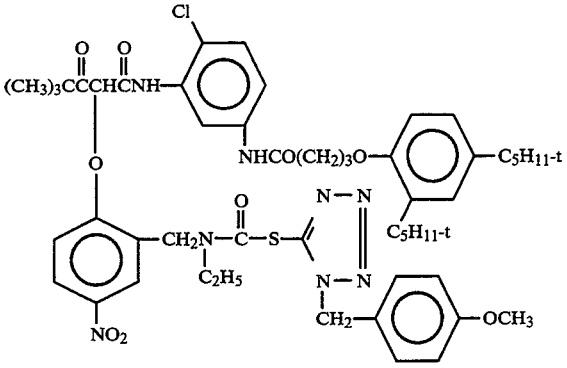
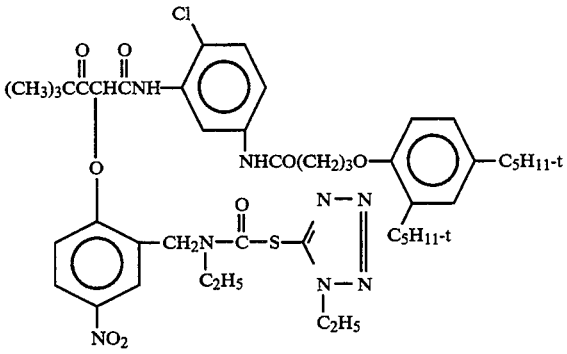
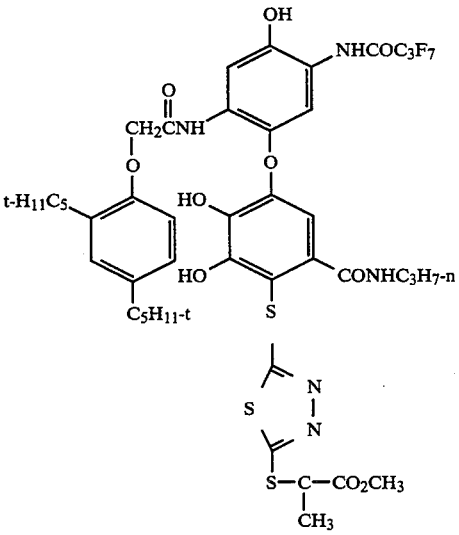
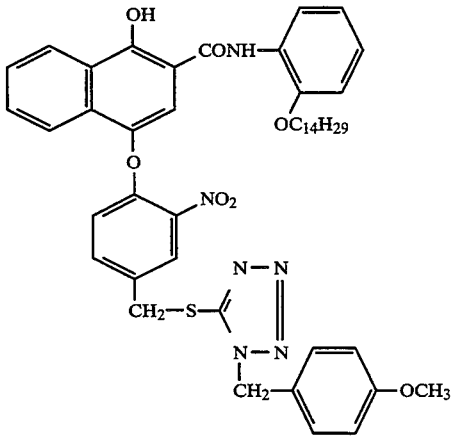
-continued
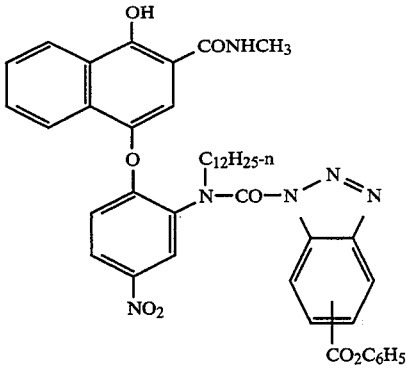
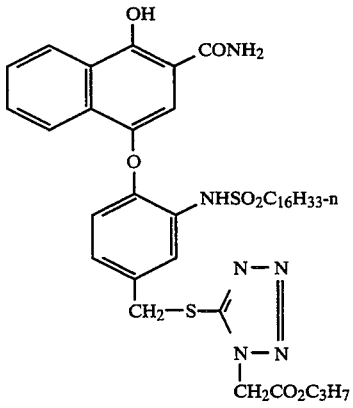
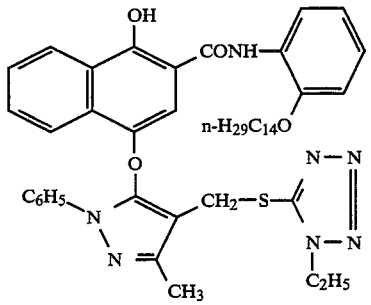
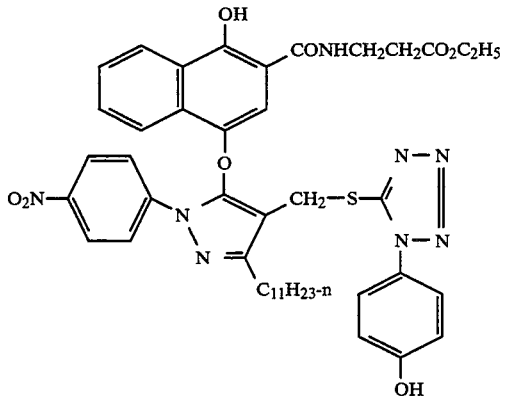

-continued

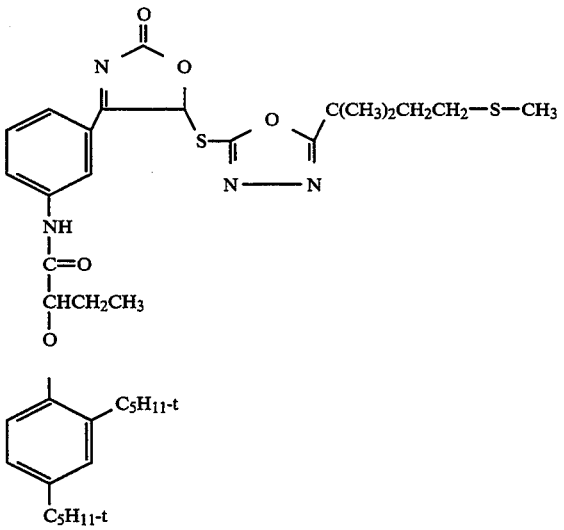

Suitable vehicles for the emulsion layers and other layers of photographic materials of this invention are described in *Research Disclosure* Item 308119, Section IX, and the publications cited therein.

In addition to the couplers described herein, the materials of this invention can include additional couplers as described in *Research Disclosure* Section VII, paragraphs D, E, F, and G, and the publications cited therein. These additional couplers can be incorporated as described in *Research Disclosure* Section VII, paragraph C, and the publications cited therein.

The photographic materials of the invention may also comprise Bleach Accelerator Releasing (BAR) compounds as described in European Patents 0 193 389 B and 0 310 125; and at U.S. Pat. No. 4,842,994, and Bleach Accelerator Releasing Silver Salts as described at U.S. Pat. Nos. 4,865,956 and 4,923,784 hereby incorporated by reference. Typical structures of such useful compounds include:

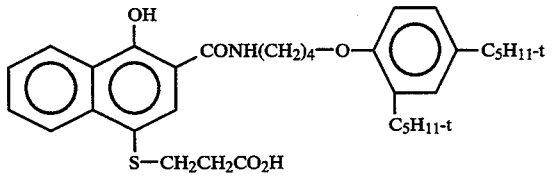

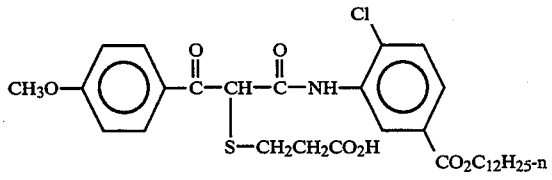

-continued

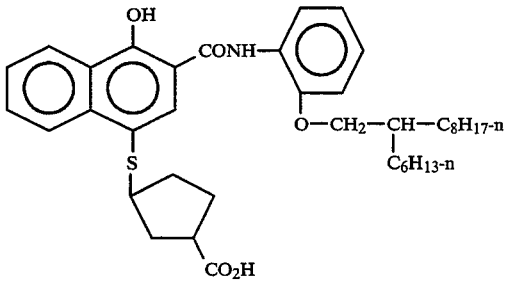

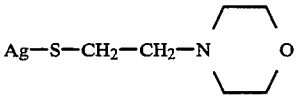

Other useful bleaching and bleach accelerating compounds and solutions are described in the above publications, the disclosures of which are incorporated by reference.

The photographic materials of this invention can be used with colored masking couplers as described in U.S. Pat. Nos. 4,883,746 and 4,833,069.

The photographic materials of this invention can contain brighteners (*Research Disclosure* Section V), antifoggants and stabilizers (*Research Disclosure* Section VI), antistain agents and image dye stabilizers (*Research Disclosure* Section VII, paragraphs I and J), light absorbing and scattering materials (*Research Disclosure* Section VIII), hardeners (*Research Disclosure* Section XI), plasticizers and lubricants (*Research Disclosure* Section XII), antistatic agents (*Research Disclosure* Section XIII), matting agents (*Research Disclosure* Section XVI), and development modifiers (*Research Disclosure* Section XXI).

The photographic materials can comprise polymer latexes as described in U.S. patent application Ser. Nos. 720,359 and 720,360 filed Jun. 25, 1991, and 771,016 filed Oct. 1, 1991, and in U.S. Pat. Nos. 3,576,628; 4,247,627; and 4,245,036, the disclosures of which are incorporated by reference.

The photographic materials can be coated on a variety of supports as described in *Research Disclosure* Section XVII and the references described therein.

Photographic materials can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the material with a color developing agent to reduce developable silver halide and oxidize the color developing agent. Oxidized color developing agent in turn reacts with the coupler to yield a dye.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing to remove silver and silver halide, washing, and drying.

Typical bleach baths contain an oxidizing agent to convert elemental silver, formed during the development step, to silver halide. Suitable bleaching agents include ferricyanides, dichromates, ferric complexes of aminocarboxylic acids, such as ethylene diamine tetraacetic acid and 1,3-propylene diamine tetraacetic acid as described at *Research Disclosure*, Item No. 24023 of April, 1984. Also useful are peroxy bleaches such as persulfate, peroxide, perborate, and percarbonate. These bleaches may be most advantageously employed by additionally employing a bleach accelerator releasing compound in the film structure. They may also be advantageously employed by contacting the film structure with a bleach accelerator solution during photographic processing. Useful bleach accelerator releasing compounds and bleach accelerator solutions are discussed in European Patents 0 193 389B and 0 310 125A; and in U.S. Pat. Nos. 4,865,956; 4,923,784; and 4,842,994, the disclosures of which are incorporated by reference.

Fixing baths contain a complexing agent that will solubilize the silver halide in the element and permit its removal from the element. Typical fixing agents include thiosulfates, bisulfites, and ethylenediamine tetraacetic acid. Sodium salts of these fixing agents are especially useful. These and other useful fixing agents are described in U.S. Pat. No. 5,183,727, the disclosures of which are incorporated by reference.

In some cases the bleaching and fixing baths are combined in a bleach/fix bath.

The following examples illustrate the practice of this invention. They are not intended to be exhaustive of all possible variations of the invention. Parts and percentages are by weight unless otherwise indicated.

Specific samples of High Aspect Ratio Tabular Grain Silver Halide Emulsions that can be employed to demonstrate the practice of this invention may be precipitated and sensitized according to the following procedures. Silver Halide emulsions useful in the practice of the invention are not, however, limited to those specific samples exemplified below.

Emulsion Precipitation and Sensitization Example 1

1. Starting kettle: 45° C., 16 g oxidized gelatin (limed ossein gelatin, treated with peroxide to oxidize all methionine groups), 28 g NaBr, 3990 g distilled water, 2 ml of Nalco-2341 antifoam (pBr=1.29).
2. Nucleation stage:
   a. Single jet run @33 ml/min, 0.2164 N $AgNO_3$, for two minutes.
   b. Continue single jet silver run; raise kettle temperature from 45° C. to 60° C. over 7.5 minutes.
   c. Adjust kettle pH with 5 ml of concentrated $NH_4OH$ (14.8M) diluted to 200 ml with distilled water. Continue single jet silver run throughout this segment for 5 minutes.
   d. Stop silver run. Adjust kettle pH to starting value with 3.5 ml of concentrated $HNO_3$, diluted to 200 ml with distilled water. Hold for 2 minutes.
   e. Add to kettle: 200 g of oxidized gelatin dissolved in 3991 g distilled water at 60° C. Hold 5 minutes.
3. Lateral growth:

Double jet with pBr controlled at 1.82, using 3.0N $AgNO_3$ and a salt solution which is 2.991M NaBr and 0.033M KI; following to the flow rate profile below:

10 minutes 20 ml/min
10 minutes 20 to 47 ml/min
10 minutes 47 to 87 ml/min
11.1 minutes 87 to 145.9 ml/min 4. Add to kettle a 292.5 g NaBr and 9.55 g KI dissolved in 535.5 g of distilled water. Hold 2 minutes.
5. Add to kettle 14.3 ml of a solution containing 0.17 mg/ml potassium selenocyanate, diluted to 150 ml with distilled water. Hold 2 minutes.
6. Add 0.316 mole of AgI Lippmann emulsion to kettle. Hold 2 minutes.
7. Single jet silver run with 3N $AgNO_3$ at 100 ml/min for 10.3 minutes. Reduce silver addition rate to 10 ml/min until kettle pBr reaches 2.50.
8. Wash emulsion to pBr=3.40 at 40° C. using ultrafiltration, concentrate, add 226 gm of limed ossein gelatin, 80 ml of solution containing 0.34 mg/ml 4-chloro-3,5-xylenol in methanol, chill set, and store.

The resulting emulsion is 4.1 mole % I.

This formula can be used to prepare emulsions typically 0.07 to 0.10 microns thick. Variations which can be made to this formula include changes in nucleation flowrate, the volume and gelatin concentration in the dump following the precipitation, and lateral growth pBr. The formula may also be scaled-up to produce larger quantities.

Green light spectral sensitizations (per mole of silver):

This procedure is representative of the green light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.
b. Add 150 mg NaSCN. Hold 20 minutes with stirring.
c. Add green light spectral sensitizing dyes at 1.4 mmole dye/mole Ag. Higher or lower mole ratios may be employed in specific sensitizations. Single sensitizing dye or multiple sensitizing dye sensitizations may be employed as known in the art. When multiple dye sensitizations are employed, the dyes may be added together or may be added separately with an optional hold time between additions.
d. Add 3.00 mg of sodium thiosulfate pentahydrate. Hold 2 minutes.
e. Add 1.5 mg of potassium tetrachloroaurate(III). Hold 2 minutes.
f. Add 36.50 mg finish modifier (3-(N-methylsulfonyl)carbamoylethyl benzothiazolium tetrafluoroborate). Hold 15 minutes.
g. Raise melt temperature from 40° to 60° C. over 15 minutes. Hold at 65 degrees for 20 minutes. Cool rapidly to 40 degrees and chill set with stirring.

Red light spectral sensitization (per mole of silver):

This procedure is representative of the red light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.
b. Add 120 mg NaSCN. Hold 20 minutes with stirring.
c. Add red light spectral sensitizing dyes at 1.3 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.
d. Add 2.50 mg of sodium thiosulfate pentahydrate. Hold 2 minutes.
e. Add 1.25 mg of potassium tetrachloroaurate(III). Hold 2 minutes.
f. Add 20.0 mg finish modifier (3-(N-methylsulfonyl)-carbamoylethyl benzothiazolium tetrafluoroborate). Hold 15 minutes.
g. Raise melt temperature from 40 to 60 degrees over 12 minutes. Hold at 60 degrees for 25 minutes. Cool rapidly to 40 degrees and chill set with stirring.

Emulsion Precipitation and Sensitization Example 2A

The preparation of thickened emulsions can be based on the formula given in Emulsion Precipitation and Sensitization Example 1 above. In this example the emulsion sample is precipitated as in Example 1 with the following changes:

The starting kettle temperature is 55° C. and the temperature ramp during step 2a is from 55° to 70° C. The remainder of the make is at 70° C. Limed ossein gelatin was used in place of the oxidized gelatin in step 2e. The pBr for the lateral growth step was 1.96 at 70° C. The resulting emulsion was 1.90 microns equivalent circular diameter and 0.139 microns thick.

This procedure is representative of the red light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gelatin content to 78 g/mole silver.
b. Add 100 mg NaSCN. Hold 20 minutes with stirring.
c. Add red light spectral sensitizing dyes at 0.9 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.
d. Add 2.00 mg of sodium thiosulfate pentahydrate. Hold 2 minutes.
e. Add 1.00 mg of potassium tetrachloroaurate(III). Hold 2 minutes.
f. Add 20.0 mg finish modifier (3-(N-methylsulfonyl)-carbamoylethyl benzothiazolium tetrafluoroborate). Hold 15 minutes.
g. Raise melt temperature from 40 to 62.5 degrees over 13.5 minutes. Hold at 62.5 degrees for 12 minutes. Cool rapidly to 40 degrees and chill set with stirring.

Emulsion Precipitation and Sensitization Example 2B

In another example the emulsion sample is precipitated as in Example 1 with the following changes:

The starting kettle temperature is 50° C. and the temperature ramp during step 2a is from 50° to 65° C. The remainder of the make is at 65° C. Limed ossein gelatin was used in place of the oxidized gelatin in step 2e. The pBr for the lateral growth step was 2.02 at 65° C. The resulting emulsion was 1.7 microns equivalent circular diameter and 0.145 microns thick.

This procedure is representative of the green light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.
b. Add 150 mg NaSCN. Hold 20 minutes with stirring.
c. Add green light spectral sensitizing dyes at 0.85 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.
d. Add 3.00 mg of sodium thiosulfate pentahydrate. Hold 2 minutes.
e. Add 1.50 mg of potassium tetrachloroaurate(III). Hold 2 minutes.
f. Add 40.0 mg finish modifier (3-(N-methylsulfonyl)-carbamoylethyl benzothiazolium tetrafluoroborate). Hold 15 minutes.
g. Raise melt temperature from 40 to 62.5 degrees over 13.5 minutes. Hold at 62.5 degrees for 22 minutes. Cool rapidly to 40 degrees and chill set with stirring.

Emulsion Precipitation and Sensitization Example 3

1. Starting kettle: 60° C., 25.0 g limed ossein gelatin, 55.0 g NaBr, 4872 g distilled water, 2 ml of Nalco-2341 Antifoam.
2. Nucleation stage:

a. Double-jet nucleation with 2.5M $AgNO_3$ solution and 2.71M NaBr solution, both at 30 ml/min for three minutes. This is followed by a two-minute hold.
b. Adjust kettle pH with 35 ml of concentrated $NH_4OH$ (14.8M) diluted with 65 ml distilled water. Hold for 4 minutes.
c. Adjust pH back to starting value with HNO3. One minute hold.
d. Add to kettle 140 g limed ossein gelatin and 3866 g distilled water, melted together at 60° C. Hold two minutes.

3. Lateral growth: Double jet with pBr control at pBr=1.39 at 60° C., using 2.5N $AgNO_3$ solution, and a salt solution which is 2.46M NaBr and 0.04M KI. Use a ramped flow rate profile, from 10 to 85 ml/min over 53.3 minutes. Stop the silver and salt flow, hold for 30 seconds.
4. pBr adjust segment: over 10 minutes, run 2.5N $AgNO_3$ at 40 ml/min, allowing the kettle pBr to shift to 3.26. When pBr=3.26 is reached, control at 3.26 with a 2.5M NaBr solution.

5. Add 10 ml of solution containing 0.17 mg/ml potassium selenocyanate, diluted to 100 ml with distilled water. Hold 30 seconds.
6. Add 0.3 moles of KI dissolved in distilled water to 250 ml.
7. For 35 minutes, run 2.5N $AgNO_3$ at 40 ml/min. Allow the kettle pBr to shift to 3.26, then control at pBr 3.26 with 2.5M NaBr solution.
8. Wash emulsion to pBr=3.11 using ultrafiltration, concentrate, add 260 grams of limed ossein gel, 80 ml of solution containing 0.34 mg/ml of 4-chloro-3,5-xylenol in methanol, chill set, and store.

The resulting emulsion was 1.7 microns equivalent circular diameter and 0.15 microns thick, with 3.6% iodide.

This procedure is representative of the green light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C.
b. Add 100 mg NaSCN. Hold 20 minutes with stirring.
c. Add green light spectral sensitizing dyes at 0.9 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.
d. Add 40.0 mg finish modifier (3-(N-methylsulfonyl)carbamoylethyl benzothiazolium tetrafluoroborate). Hold 15 minutes.
e. Adjust melt pBr to 3.40 with dilute $AgNO_3$.
f. Add 1.50 mg of potassium tetrachloroaurate(III). Hold 2 minutes.
g. Add 3.00 mg of sodium thiosulfate pentahydrate. Hold 2 minutes.
g. Raise melt temperature from 40 to 65.0 degrees over 15.0 minutes. Hold at 65.0 degrees for 8 minutes. Cool rapidly to 40 degrees and chill set with stirring.

Emulsion Precipitation and Sensitization Example 4

1. Starting kettle: 65° C., total volume of 4.0 liters, with 5.0 g/L limed ossein gelatin and 11.0 g/L NaBr. No anti-foamant was used.
2. Nucleation stage:
   a. Double-jet nucleation using 1.00M $AgNO_3$ and 1.2M NaBr solutions, both at 82 ml/min. This is followed by a two-minute hold.
   b. Adjust kettle pH with 25 ml of concentrated $NH_4OH$ (14.8M) diluted with 76 ml of distilled water. Hold for 4 minutes.
   c. Adjust pH back to starting value with $HNO_3$. One minute hold.
   d. Add to kettle a 5-L solution containing 140 g of limed ossein gelatin at 65° C. Hold 2 minutes.
3. Lateral growth: Double jet with pBr control at 1.55 at 65° C., using 2.5M $AgNO_3$, and a salt solution which is 2.46M NaBr and 0.04M KI. Use a ramped flow rate profile, from 8 to 82 ml/min over 53.5 minutes.
4. pBr adjust segment: over 10 minutes, run 2.5N $AgNO_3$ at 40 ml/min, allowing the kettle pBr to reach 3.20. When pBr 3.20 is reached, control pBr at 3.20 with a 2.5M NaBr solution.
5. Add 0.3 moles of KI dissolved in distilled water to 200 ml.
6. For 5 minutes, run 2.5N $AgNO_3$ at 40 ml/min, allowing the kettle pBr to shift to 3.20, then control at pBr=3.20 with 2.5M NaBr solution.
7. Continue double jet silver and salt for 20 minutes, except using a 2.5M NaBr solution which contains 100 mg $Na_3Fe(CN)_6$.
8. Continue double jet silver and salt for 10 minutes, using 2.5M NaBr.
9. After lowering the temperature to 50° C., add 2.5M NaBr to the kettle to adjust the pBr to 2.62. Wash the emulsion to pBr=3.25 using ultrafiltration, concentrate, add 260 g of limed ossein gel, 80 ml of solution containing 0.34 mg/ml of 4-chloro-3,5-xylenol in methanol, chill set and store.

The resulting emulsion was 1.9 microns equivalent circular diameter and 0.143 microns thick, with 3.6% iodide.

This procedure is representative of the red light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 35.0% gelatin solution (use limed ossein gelatin) to bring gelatin content to 77 g/mole silver.
b. Add 150 mg NaSCN. Hold 20 minutes with stirring.
c. Add red light spectral sensitizing dyes at 1.0 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.
d. Add 3.50 mg of sodium thiosulfate pentahydrate. Hold 2 minutes.
e. Add 1.75 mg of potassium tetrachloroaurate(III). Hold 2 minutes.
f. Add 40.0 mg of finish modifier (3-(N-methylsulfonyl)-carbamoylethyl benzothiazolium tetrafluoroborate). Hold 15 minutes.
g. Raise melt temperature from 40 to 65.0 degrees over 15.0 minutes. Hold at 65.0 degrees for 5 minutes. Cool rapidly to 40 degrees and chill set with stirring. Add additional heat to the emulsion by melting at 40° C., increase melt temperature from 40° to 65° C. over 15 minutes, hold for 15 minutes, and chill set with stirring.

Photographic Example 1

A photographic recording material (Photographic Sample 1) was prepared by applying the following layers in the given sequence to a transparent cellulose triacetate support. The quantities of silver halide are given in g of silver per $m^2$. The quantities of other materials are in g per $m^2$.

Layer 1 {Antihalation Layer} black colloidal silver sol containing 0.236 g of silver, with 2.44 g of gelatin.

Layer 2 {Photographic Layer} Green sensitized silver iodobromide emulsion [6.3 mol % iodide, average grain diameter 0.52 microns, average grain thickness ca. 0.17 microns, conventional morphology] at 1.61 g, cyan dye-forming image coupler C-2 at 0.73 g with gelatin at 3.23 g.

Layer 3 {Protective Layer} Gelatin at 3.23 g.

The film was hardened at coating with 2% by weight to total gelatin of hardener S-1. Surfactants, coating aids, scavengers and stabilizers were added to the various layers of this sample as is commonly practiced in the art. The image coupler was dispersed in an equal weight of dibutyl phthalate.

Photographic Sample 2 was prepared like Photographic Sample 1 except that 0.13 g of DIR compound D-3 was added to layer 2.

Photographic Samples 3 and 4 were prepared like Photographic Samples 1 and 2 respectively except that the silver halide emulsion in layer 2 was replaced by an equal weight of a green sensitized silver iodobromide emulsion [6 mol % iodide, average grain diameter 2.3 microns, average grain thickness 0.11 microns].

Photographic Samples 21–24 were prepared like Photographic Samples 1–4 except that 0.043 g of soluble green absorber dye SOL-M1 was added to layer 3.

These samples had a total thickness above the support of about 9 microns and a total imaging layer thickness from the portion of an imaging layer closest to the support to a portion of an imaging layer furthest from the support of about 5 microns. The samples containing a DIR compound had about 1.08 mol % DIR to sensitized silver.

Photographic Samples 1–24 were exposed using white light to sinusoidal patterns to determine the Modulation Transfer Function (MTF) Percent Response as a function of spatial frequency in the film plane. Specific details of this exposure-evaluation cycle can be found at R. L. Lamberts and F. C. Eisen, "A System for the Automated Evaluation of Modulation Transfer Functions of Photographic Materials", in the *Journal of Applied Photographic Engineering*, Vol. 6, pages 1–8, February 1980. A more general description of the determination and meaning of MTF Percent Response curves can be found in the articles cited within this reference. The exposed samples were developed generally according to the C-41 Process as described in the *British Journal of Photography Annual* for 1988 at pages 196–198. The bleaching solution composition was modified so as to comprise 1,3-propylene diamine tetraacetic acid. The exposed and processed samples were evaluated to determine the MTF Percent Response as a function of spatial frequency in the film plane as described above.

As is readily apparent on examination of the photographic data shown in Table 1, the samples incorporating both the High Aspect Ratio Tabular Grain silver halide emulsions and the distributed absorber dye show a larger improvement in MTF Percent Response than would have been anticipated based on the performance of the comparative samples. An even larger improvement in MTF Percent Response unexpectedly occurs when a DIR compound is additionally present.

Photographic Example 2

A color photographic recording material (Photographic Sample 201) for color negative development was prepared by applying the following layers in the given sequence to a transparent support of cellulose triacetate. The quantities of silver halide are given in g of silver per $m^2$. The quantities of other materials are given in g per $m^2$. All silver halide emulsions were stabilized with about 2 grams of 4-hydroxy-6-methyl-1,3,3a,7-tetraazaindene per mole of silver.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.65 microns, average grain thickness 0.09 micron] at 0.43 g, red sensitized silver iodobromide emulsion [4.2 mol % iodide, average grain diameter 1.7 microns, average grain thickness 0.08 micron] at 0.54 g, cyan dye-forming image coupler C-1 at 0.65 g, DIR compound D-1 at 0.022 g, DIR compound D-3 at 0.002 g, cyan dye-forming masking coupler CM-1 at 0.022 g with gelatin at 1.61 g.

Layer 3 {Second (more) Red-Sensitive Layer} Red sensitized silver iodobromide emulsion [4.2 mol % iodide, average grain diameter 2.1 microns, average grain thickness 0.09 microns] at 1.18 g, cyan dye-forming image coupler C-2 at 0.23 g, DIR compound D-1 at 0.041 g, DIR compound D-5 at 0.008 g, BAR compound B-1 at 0.003 g, cyan dye-forming masking coupler CM-1 at 0.027 g, with gelatin at 1.61 g.

Layer 4 {Interlayer} Oxidized developer scavenger S-1 at 0.054 g, yellow dye material YD-1 at 0.12 g and 1.29 g of gelatin.

Layer 5 {First (less) Green-Sensitive Layer} Green sensitized silver iodobromide emulsion [3.9 mol % iodide, average grain diameter 0.75 microns, average thickness 0.1 microns] at 0.75 g, magenta dye-forming image coupler M-1 at 0.11 g, magenta dye-forming image coupler M-2 at 0.22 g, DIR compound D-2 at 0.004 g, DIR compound D-3 at 0.011 g, magenta dye-

TABLE 1

MTF Percent Response as a Function of Film Formulation After Color Negative Film Processing, Process C-41

| Sample[a] | Emulsion[b] Type | Absorber[c] Dye | DIR[d] | MTF Percent Response[e] 2.5 c/mm | 5 c/mm | 50 c/mm | 80 c/mm |
|---|---|---|---|---|---|---|---|
| 1 C | C | N | none | 98 | 98 | 51 | 30 |
| 21 C | C | Y | none | 98 | 99 | 61 | 37 |
| 3 C | T | N | none | 102 | 100 | 78 | 58 |
| 23 I | T | Y | none | 107 | 109 | 91 | 48 |
| 2 C | C | N | D-3 | 117 | 120 | 80 | 58 |
| 22 C | C | Y | D-3 | 121 | 125 | 90 | 66 |
| 4 C | T | N | D-3 | 120 | 125 | 103 | 80 |
| 24 I | T | Y | D-3 | 127 | 131 | 121 | 93 |

[a]Samples are identified as comparative (C) or inventive (I).
[b]Emulsions are identified as conventional morphology (C) or High Aspect Ratio Tabular morphology (T).
[c]Presence (Y) or absence (N) of a distributed absorber dye.
[d]Presence and identity of DIR compound in the photographic material.
[e]MTF Percent Response as a function of spatial frequency in the film plane for the photographic material.

forming masking coupler MM-1 at 0.032 g, oxidized developer scavenger S-2 at 0.002 g, with gelatin at 1.29 g.

Layer 6 {Second (more) Green-Sensitive Layer} Green sensitized silver iodobromide emulsion [4 mol % iodide, average grain diameter 1.4 microns, average thickness 0.09 microns] at 0.97 g, magenta dye-forming image coupler M-1 at 0.054 g, magenta dye-forming image coupler M-2 at 0.054 g, DIR compound D-2 at 0.008 g, DIR compound D-3 at 0.01 g, magenta dye-forming masking coupler MM-1 at 0.022 g, oxidized developer scavenger S-2 at 0.007 g, with gelatin at 1.88 g.

Layer 7 {Third (most) Green-Sensitive Layer} Green sensitized silver iodobromide emulsion [4 mol % iodide, average grain diameter 2.2 microns, average grain thickness 0.08 microns] at 0.97 g, magenta dye-forming image coupler M-1 at 0.043 g, magenta dye-forming image coupler M-2 at 0.048 g, magenta dye-forming masking coupler MM-1 at 0.032 g, DIR compound D-2 at 0.003 g, DIR compound D-3 at 0.007 g, oxidized developer scavenger S-2 at 0.008 g, BAR compound B-2 at 0.002 g, with gelatin at 1.51 g.

Layer 8 {Interlayer} Oxidized developer scavenger S-1 at 0.021 g, with 0.54 g of gelatin.

Layer 9 {Interlayer} Yellow dye YD-2 at 0.11 g with 1.08 g of gelatin.

Layer 10 {First (less) Blue-Sensitive Layer} Blue sensitized silver iodobromide emulsion [6 mol % iodide, average grain diameter 0.4 microns, average grain thickness 0.18 micron] at 0.16 g, blue sensitized silver iodobromide emulsion [6 mol % iodide, average grain diameter 1.1 microns, average grain thickness 0.36 micron] at 0.22 g, yellow dye-forming image coupler Y-1 at 0.86 g, DIR compound D-4 at 0.038 g with gelatin at 1.61 g.

Layer 11 {Second (more) Blue-Sensitive Layer} Blue sensitized silver iodobromide emulsion [6 mol % iodide, average grain diameter 2 microns, average grain thickness 0.35 microns] at 0.75 g, yellow dye-forming image coupler Y-1 at 0.22 g, DIR compound D-4 at 0.038 g, BAR compound B-1 at 0.005 g with gelatin at 1.21 g.

Layer 12 {Protective Layer} 0.108 g of dye UV-1, 0.118 g of dye UV-2, unsensitized silver bromide Lippman emulsion at 0.108 g, anti-matte polyacrylamide beads at 0.054 g, ballasted absorber dye CD-1 at 0.005 g, ballasted absorber dye MD-1 at 0.001 g with gelatin at 1.22 g.

This film was hardened at coating with 2% by weight to total gelatin of hardener H-1. Surfactants, coating aids, scavengers, film base antihalation dyes and stabilizers were optionally added to the various layers of this sample as is commonly practiced in the art.

Samples 201 through 205 had a total thickness above the support of about 23 microns and a total imaging layer thickness from the portion of an imaging layer closest to the support to a portion of an imaging layer furthest from the support of about 20 microns. The samples contained DIR compound at about 0.43 mol % DIR to sensitized silver. Sample 202 exhibited a sensitivity of about ISO 200 while sample 203 exhibited a sensitivity of about ISO 100.

Photographic Sample 202 was prepared like Photographic Sample 201 except that 0.032 g of soluble red light absorber dye SOL-C1 and 0.032 g of soluble green light absorber dye SOL-M1 were added at coating to layer 8. The soluble dye distribute throughout the coating structure during the coating preparation procedure.

Photographic Sample 203 was prepared like Photographic Sample 201 except that 0.064 g of soluble red light absorber dye SOL-C1 and 0.064 g of soluble green light absorber dye SOL-M1 were added at coating to layer 8. The soluble dye distribute throughout the coating structure during the coating preparation procedure.

Photographic Sample 204 was prepared like Photographic Sample 201 except that the emulsion in layer 3 was replaced by an equal weight of a red sensitized silver iodobromide emulsion [4.2 mol % iodide, average grain diameter 2.0 microns, average grain thickness 0.14 microns], and that the emulsion in layer 7 was replaced by an equal weight of a green sensitized silver iodobromide emulsion [4 mol % iodide, average grain diameter 1.7 microns, average grain thickness 0.15 microns]

Photographic Sample 205 was prepared like Photographic Sample 204 except that 0.064 g of soluble red light absorber dye SOL-C1 and 0.064 g of soluble green light absorber dye SOL-M1 were added at coating to layer 8. The soluble dye distribute throughout the coating structure during the coating preparation procedure.

Photographic Sample 306 was prepared in a manner analogous to that used prepare Photographic Sample 201 by applying the following layers in the given sequence to a transparent support of cellulose triacetate.

Layer 1 {Antihalation Layer} black colloidal silver sol containing 0.256 g of silver, with 2.69 g gelatin.

Layer 2 {First (less) Red-Sensitive Layer} Red sensitized silver iodobromide emulsion [4.8 mol % iodide, average grain diameter 0.3 microns, conventional morphology] at 0.75 g, red sensitized silver iodobromide emulsion [6.1 mol % iodide, average grain diameter 0.8 microns, conventional morphology] at 2.01 g, cyan dye-forming image coupler C-1 at 0.62 g, DIR compound D-6 at 0.045 g, cyan dye-forming masking coupler CM-1 at 0.16 g with gelatin at 2.76 g.

Layer 3 {Second (more) Red-Sensitive Layer} Red sensitized silver iodobromide emulsion [6.0 mol % iodide, average grain diameter 1 micron, conventional morphology] at 1.58 g, cyan dye-forming image coupler C-1 at 0.13 g, DIR compound D-5 at 0.015 g, DIR compound D-1 at 0.02 g, cyan dye-forming masking coupler CM-1 at 0.027 g with gelatin at 1.58 g.

Layer 4 {Interlayer} Oxidized developer scavenger S-2 at 0.16 g, and 0.65 g of gelatin.

Layer 5 {First (less) Green-Sensitive Layer} Green sensitized silver iodobromide emulsion [4.8 mol % iodide, average grain diameter 0.26 microns, conventional morphology] at 0.95 g, green sensitized silver iodobromide emulsion [6.4 mol % iodide, average grain diameter 0.5 microns, conventional morphology] at 0.77 g, magenta dye-forming image coupler M-3 at 0.67 g, DIR compound D-2 at 0.032 g, magenta dye-forming masking coupler MM-2 at 0.06 g with gelatin at 2.18 g.

Layer 6 {Second (more) Green-Sensitive Layer} Green sensitized silver iodobromide emulsion [12 mol % iodide, average grain diameter 0.8 microns, conventional morphology] at 1.08 g, magenta dye-forming image coupler M-3 at 0.34 g, magenta dye-forming masking coupler MM-2 at 0.03 g, DIR compound D-2 at 0.022 g with gelatin at 1.15 g.

Layer 7 {Interlayer} Gelatin at 0.43 g.

Layer 8 {Interlayer} Oxidized developer scavenger S-2 at 0.08 g, yellow colloidal silver at 0.067 g with 0.43 g of gelatin.

Layer 9 {First (less) Blue-Sensitive Layer} Blue sensitized silver iodobromide emulsion [4.8 mol % iodide, average grain diameter 0.3 microns, conventional morphology] at 0.17 g, blue sensitized silver iodobromide emulsion [6 mol % iodide, average grain diameter 0.6 microns, conventional morphology] at 0.37 g, yellow dye-forming image coupler Y-2 at 1.29 g, with gelatin at 1.61 g.

Layer 10 {Second (more) Blue-Sensitive Layer} Blue sensitized silver iodobromide emulsion [9 mol % iodide, average grain diameter 0.9 microns, conventional morphology] at 0.75 g, yellow dye-forming image coupler Y-2 at 0.088 g, with gelatin at 0.76 g.

Layer 11 {Protective Layer 1} UV protective dye UV-1 at 0.066 g, UV protective dye UV-2 at 0.11 g unsensitized silver bromide Lippman emulsion at 0.21 g, with gelatin at 0.54 g.

Layer 12 {Protective Layer 2} Anti-matte beads at 0.086 g and gelatin at 0.89 g.

Photographic Sample 307 was prepared like Photographic Sample 306 except that the sensitivity of the red and green light sensitive layers was reduced by 50%. The sensitivity of the red light sensitive layers was reduced by utilizing a lesser quantity (76% by weight) of smaller sized grains in layer 2 (0.26 and 0.5 microns average equivalent circular diameter, conventional morphology) and in layer 3 (0.8 microns average equivalent circular diameter, conventional morphology). The sensitivity of the green light sensitive layers was reduced by adding 0.086 g of SOL-M1, a soluble green light absorbing dye to the coating structure. The soluble dye (SOL-M1) was added in layer 11 and distributes itself throughout the coating structure during the manufacturing procedures.

Samples 306 and 307 employed conventional emulsions with an aspect ratio of about 3 in all sensitized layers. These samples had a total thickness above the support of about 22 microns and a total imaging layer thickness from the portion of an imaging layer closest to the support to a portion of an imaging layer furthest from the support of about 18 microns. The samples contained DIR compound at about 0.23 mol % DIR to sensitized silver. Photographic Sample 408 was prepared in a manner analogous to that used to prepare Photographic Sample 201 by applying the following layers in the given sequence to a transparent support of cellulose triacetate.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.65 microns, average grain thickness 0.09 micron] at 0.43 g, red sensitized silver iodobromide emulsion [4.2 mol % iodide, average grain diameter 1.7 microns, average grain thickness 0.08 micron] at 0.54 g, cyan dye-forming image coupler C-1 at 0.65 g, DIR compound D-1 at 0.032 g, cyan dye-forming masking coupler CM-1 at 0.011 g, BAR compound B-1 at 0.038 g with gelatin at 1.78 g.

Layer 3 {Second (more) Red-Sensitive Layer} Red sensitized silver iodobromide emulsion [4 mol % iodide, average grain diameter 2 microns, average grain thickness 0.14 microns] at 1.18 g, cyan dye-forming image coupler C-2 at 0.23 g, DIR compound D-1 at 0.043 g, DIR compound D-5 at 0.004 g, BAR compound B-1 at 0.003 g, cyan dye-forming masking coupler CM-1 at 0.027 g, with gelatin at 1.66 g.

Layer 4 {Interlayer} Oxidized developer scavenger S-1 at 0.054 g, yellow dye material YD-1 at 0.086 g and 1.29 g of gelatin.

Layer 5 {First (less) Green-Sensitive Layer} Green sensitized silver iodobromide emulsion [3.9 mol % iodide, average grain diameter 0.75 microns, average thickness 0.1 microns] at 0.75 g, magenta dye-forming image coupler M-1 at 0.11 g, magenta dye-forming image coupler M-2 at 0.22 g, DIR compound D-2 at 0.002 g, DIR compound D-3 at 0.011 g, magenta dye-forming masking coupler MM-1 at 0.032 g, oxidized developer scavenger S-2 at 0.002 g, with gelatin at 1.29 g.

Layer 6 {Second (more) Green-Sensitive Layer} Green sensitized silver iodobromide emulsion [4 mol % iodide, average grain diameter 1.1 microns, average thickness 0.12 microns] at 0.97 g, magenta dye-forming image coupler M-1 at 0.054 g, magenta dye-forming image coupler M-2 at 0.054 g, DIR compound D-2 at 0.008 g, DIR compound D-3 at 0.01 g, magenta dye-forming masking coupler MM-1 at 0.022 g, oxidized developer scavenger S-2 at 0.007 g, with gelatin at 1.51 g.

Layer 7 {Third (most) Green-Sensitive Layer} Green sensitized silver iodobromide emulsion [4 mol % iodide, average grain diameter 1.7 microns, average grain thickness 0.15 microns] at 0.97 g, magenta dye-forming image coupler M-1 at 0.043 g, magenta dye-forming image coupler M-2 at 0.048 g, magenta dye-forming masking coupler MM-1 at 0.032 g, DIR compound D-2 at 0.002 g, DIR compound D-3 at 0.007 g, oxidized developer scavenger S-2 at 0.005 g, BAR compound B-2 at 0.002 g, with gelatin at 1.51 g.

Layer 8 {Interlayer} Oxidized developer scavenger S-1 at 0.021 g, with 0.54 g of gelatin.

Layer 9 {Interlayer} Yellow dye YD-2 at 0.11 g with 1.08 g of gelatin.

Layer 10 {First (less) Blue-Sensitive Layer} Blue sensitized silver iodobromide emulsion [4 mol % iodide, average grain diameter 0.9 microns, average grain thickness 0.09 micron] at 0.16 g, blue sensitized silver iodobromide emulsion [4 mol % iodide, average grain diameter 1.5 microns, average grain thickness 0.09 micron] at 0.22 g, yellow dye-forming image coupler Y-1 at 0.86 g, DIR compound D-4 at 0.038 g with gelatin at 1.61 g.

Layer 11 {Second (more) Blue-Sensitive Layer} Blue sensitized silver iodobromide emulsion [3 mol % iodide, average grain diameter 3.3 microns, average grain thickness 0.12 microns] at 0.70 g, yellow dye-forming image coupler Y-1 at 0.22 g, DIR compound D-4 at 0.038 g, BAR compound B-1 at 0.005 g with gelatin at 1.21 g.

Layer 12 {Protective Layer} 0.108 g of dye UV-1, 0.118 g of dye UV-2, unsensitized silver bromide Lippman emulsion at 0.108 g, anti-matte polyacrylamide beads at 0.054 g, with gelatin at 1.22 g.

Photographic Sample 409 was prepared like Photographic Sample 408 except that 0.036 g of soluble red light absorber dye SOL-C1 and 0.054 g of soluble green light absorber dye SOL-M1 were added at coating to layer 8. The soluble dye distribute throughout the coating structure during the coating preparation procedure.

Photographic Sample 410 was prepared like Photographic Sample 409 except that the tabular grain emulsion in layer 3 was replaced by an equal quantity of a red sensitized silver iodobromide emulsion [4.2 mol % iodide, average grain diameter 2.1 microns, average grain thickness 0.09 microns].

Photographic Sample 411 was prepared like Photographic Sample 410 except that the soluble absorber dyes SOL-C1 and SOL-M1 were omitted from layer 8 and the tabular grain silver halide emulsions in layer 6 and layer 7 were replaced by an equal weight of a green sensitized silver iodobromide emulsion [4 mol % iodide, average grain diameter 1.4 microns, average grain thickness 0.09 microns] in layer 6 and an equal weight of a green sensitized silver iodobromide emulsion [4 mol % iodide, average grain diameter 2.3 microns, average grain thickness 0.09 microns] in layer 7.

Photographic Sample 412 was prepared like Photographic Sample 411 except that 0.036 g of soluble red light absorber dye SOL-C1 and 0.054 g of soluble green light absorber dye SOL-M1 were added at coating to layer 8. The soluble dye distribute throughout the coating structure during the coating preparation procedure.

Photographic Sample 413 was prepared like Photographic Sample 412 except that the tabular grain emulsion in layer 3 was replaced by an equal quantity of a red sensitized silver iodobromide emulsion [4 mol % iodide, average grain diameter 2 microns, average grain thickness 0.14 microns].

Samples 408 through 413 had a total thickness above the support of about 22 microns and a total imaging layer thickness from the portion of an imaging layer closest to the support to a portion of an imaging layer furthest from the support of about 19 microns. The samples contained DIR compound at about 0.47 mol % DIR to sensitized silver.

Photographic Sample 514 was prepared in a manner analogous to that used to prepare Photographic Sample 408 by applying the following layers in the given sequence to a transparent support of cellulose triacetate.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.65 microns, average grain thickness 0.09 micron] at 0.75 g, cyan dye-forming image coupler C-1 at 0.43 g, DIR compound D-1 at 0.022 g, cyan dye-forming masking coupler CM-1 at 0.027 g, with gelatin at 1.5 g.

Layer 3 {Second (more) Red-Sensitive Layer} Red sensitized silver iodobromide emulsion [4.2 mol % iodide, average grain diameter 1.6 microns, average grain thickness 0.10 micron] at 0.97 g, cyan dye-forming image coupler C-2 at 0.16 g, DIR compound D-1 at 0.022 g, DIR coupler D-5 at 0.005 g, cyan dye-forming masking coupler CM-1 at 0.022 g, with gelatin at 1.51 g.

Layer 4 {Third (most) Red-Sensitive Layer} Red sensitized silver iodobromide emulsion [4 mol % iodide, average grain diameter 2.1 microns, average grain thickness 0.09 microns] at 0.97 g, cyan dye-forming image coupler C-2 at 0.15 g, DIR compound D-1 at 0.027 g, DIR compound D-5 at 0.005 g, cyan dye-forming masking coupler CM-1 at 0.016 g, with gelatin at 1.4 g.

Layer 5 {Interlayer} Oxidized developer scavenger S-1 at 0.16 g, yellow dye material YD-1 at 0.13 g and 0.65 g of gelatin.

Layer 6 {First (less) Green-Sensitive Layer} Green sensitized silveriodobromide emulsion [3.9 mol % iodide, average grain diameter 0.65 microns, average thickness 0.09 microns] at 0.75 g, magenta dye-forming image coupler M-1 at 0.11 g, magenta dye-forming image coupler M-2 at 0.22 g, DIR compound D-2 at 0.004 g, DIR compound D-3 at 0.011 g, magenta dye-forming masking coupler MM-1 at 0.037 g, with gelatin at 1.51 g.

Layer 7 {Second (more) Green-Sensitive Layer} Green sensitized silver iodobromide emulsion [4 mol % iodide, average grain diameter 1.4 microns, average thickness 0.09 microns] at 0.97 g, magenta dye-forming image coupler M-1 at 0.054 g, magenta dye-forming image coupler M-2 at 0.054 g, DIR compound D-2 at 0.008 g, DIR compound D-3 at 0.011 g, magenta dye-forming masking coupler MM-1 at 0.023 g, with gelatin at 0.97 g.

Layer 8 {Third (most) Green-Sensitive Layer} Green sensitized silver iodobromide emulsion [4 mol % iodide, average grain diameter 2.3 microns, average grain thickness 0.09 microns] at 0.97 g, magenta dye-forming image coupler M-1 at 0.038 g, magenta dye-forming image coupler M-2 at 0.038 g, magenta dye-forming masking coupler MM-1 at 0.016 g, DIR compound D-2 at 0.005 g, DIR compound D-3 at 0.008 g, with gelatin at 1.29 g.

Layer 9 {Interlayer} Oxidized developer scavenger S-1 at 0.16 g, with 0.65 g of gelatin.

Layer 10 {Interlayer} Yellow colloidal silver at 0.038 g, oxidized developer scavenger S-1 at 0.038 g with 0.65 g of gelatin.

Layer 11 {First (less) Blue-Sensitive Layer} Blue sensitized silver iodobromide emulsion [4 mol % iodide, average grain diameter 0.9 microns, average grain thickness 0.09 micron] at 0.33 g, blue sensitized silver iodobromide emulsion [4 mol % iodide, average grain diameter 1.5 microns, average grain thickness 0.09 micron] at 0.22 g, yellow dye-forming image coupler Y-1 at 0.86 g, DIR compound D-4 at 0.033 g, BAR compound B-2 at 0.022 g with gelatin at 2.36 g.

Layer 12 {Second (more) Blue-Sensitive Layer} Blue sensitized silver iodobromide emulsion [3 mol % iodide, average grain diameter 3.3 microns, average grain thickness 0.12 microns] at 0.76 g, yellow dye-forming image coupler Y-1 at 0.22 g, DIR compound D-4 at 0.033 g, with gelatin at 1.72 g.

Layer 13 {Protective Layer} 0.108 g of dye UV-1, 0.118 g of dye UV-2, unsensitized silver bromide Lippman emulsion at 0.108 g, 1.08 g Of Polymer Latex A, 0.22 g of Polymer Latex C, with gelatin at 1.08 g.

Layer 14 {Protective Layer} Anti-matte polyacrylamide beads at 0.054 g, dye CD-1 at 0.008 g with gelatin at 0.75 g.

Photographic Sample 515 was prepared like Photographic Sample 514 except that 0.0037 g of soluble red light absorber dye SOL-C1 and 0.0043 g of soluble green light absorber dye SOL-M1 were added at coating to layer 13. The soluble dye distribute throughout the coating structure during the coating preparation procedure.

Photographic Sample 516 was prepared like Photographic Sample 515 except that the tabular grain emulsions in layers 4 was replaced by an equal weight of a red sensitized silver iodobromide emulsion [4 mol % iodide, average grain diameter 2.0 microns, average grain thickness 0.14 microns] and the tabular grain emulsion in layer 8 was replaced by an equal weight of a green sensitized silver iodobromide emulsion [4 mol % iodide, average grain diameter 1.7 microns, average grain thickness 0.15 microns].

Photographic Sample 517 was prepared like Photographic Sample 516 except that soluble dyes SOL-C1 and SOL-M1 were omitted from layer 13.

C-1
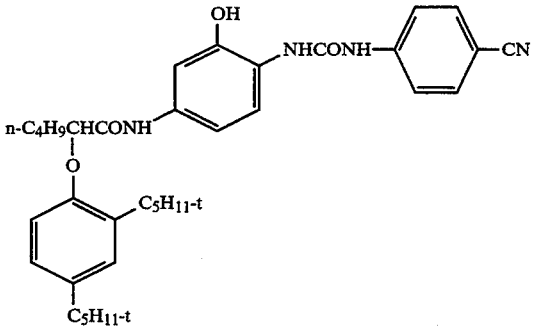
C-2
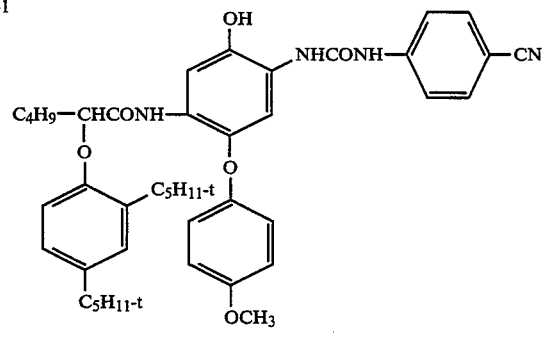
M-1
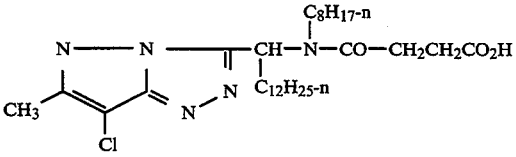
M-2
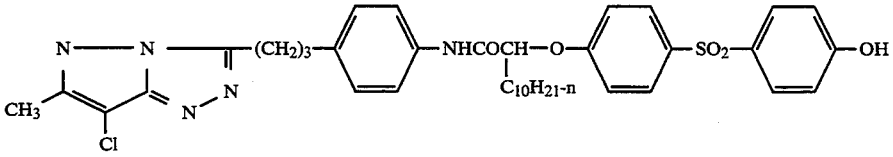
M-3
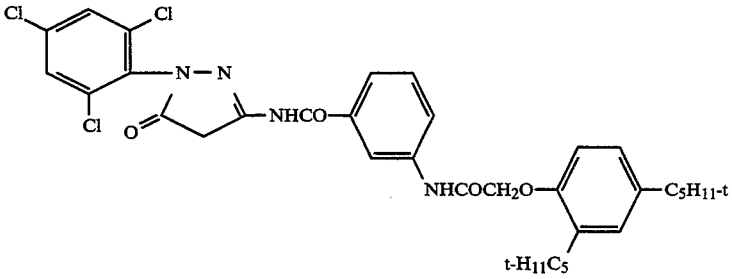
Y-1
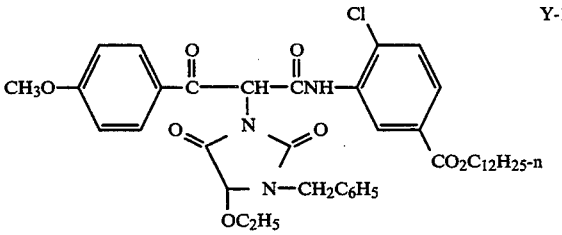
Y-2
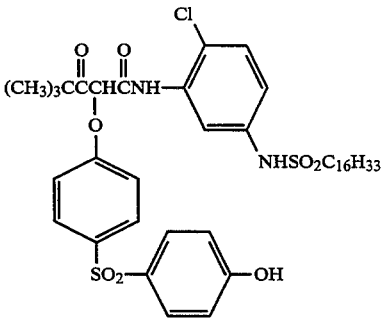

-continued
M-4
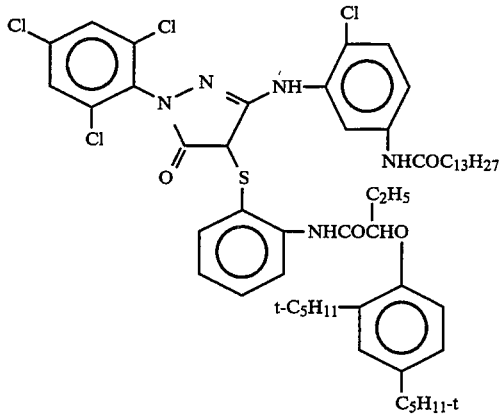
D-1
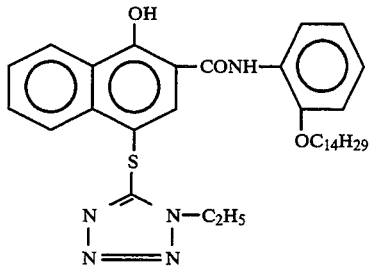
D-2
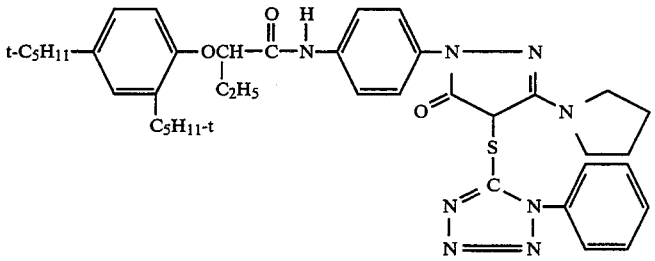
D-3
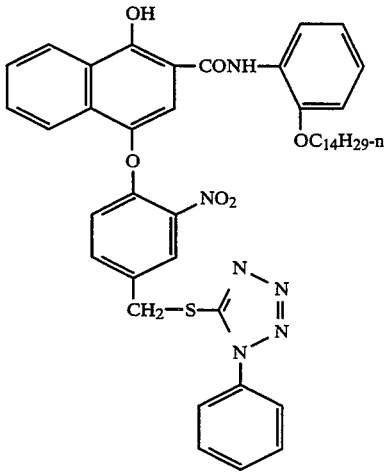
D-4
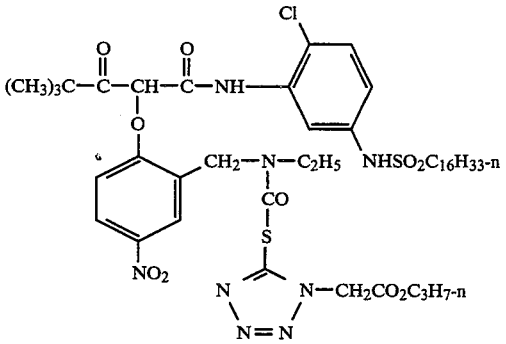
D-5
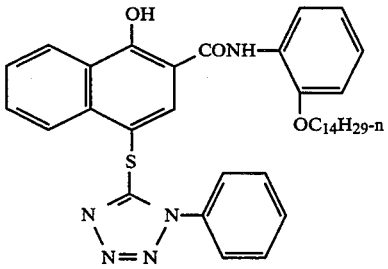
D-6
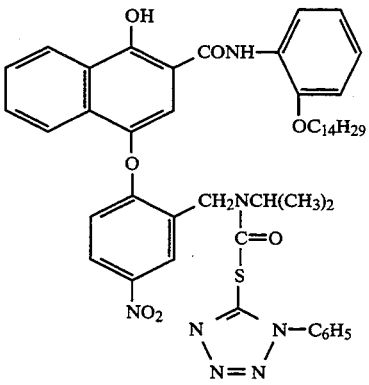

-continued

D-7

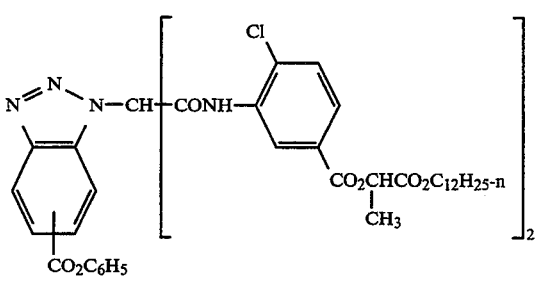

B-1

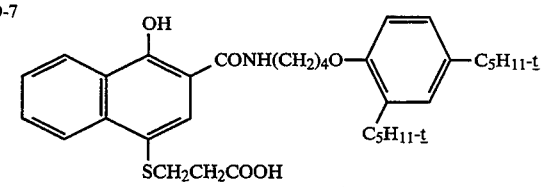

B-2

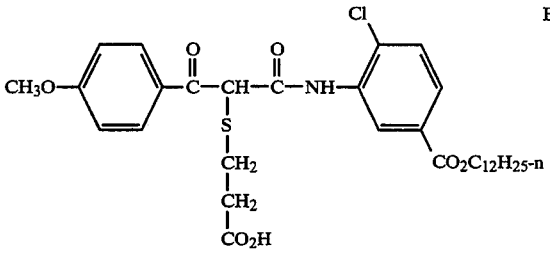

S-1

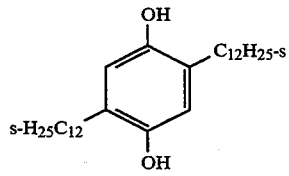

S-2

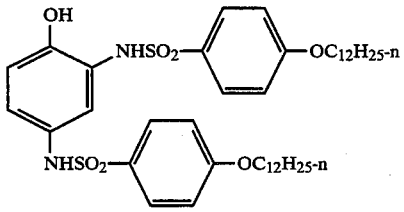

UV-1

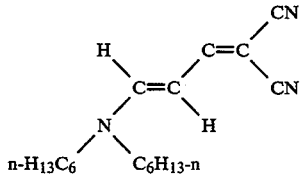

UV-2

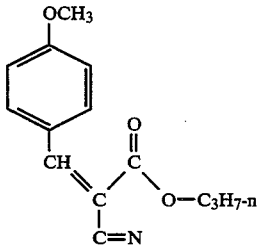

H-1

$CH_2(SO_2CH{=}CH_2)_2$

Polymer Latex A: n-butyl acrylate/2-acrylamido-2-methylpropane sulfonic acid/2-acetoacetoxyethyl methacrylate (88:5:7) Tg=−28° C.

Polymer Latex C: Methyl acrylate/2-acrylamido-2-methylpropane sulfonic acid/2-acetoacetoxyethyl methacrylate (91:5:4) Tg=+10.5° C.

The Photographic Samples were exposed using white light to sinusoidal patterns to determine the Modulation Transfer Function (MTF) Percent Response as a function of spatial frequency in the film plane. Specific details of this exposure—evaluation cycle can be found at R. L. Lamberts and F. C. Eisen, "A System for the Automated Evaluation of Modulation Transfer Functions of Photographic Materials", in the *Journal of Applied Photographic Engineering*, Vol. 6. pages 1–8, February 1980. A more general description of the determination and meaning of MTF Percent Response curves can be found in the articles cited within this reference. The exposed samples were developed generally according to the C-41 Process as described in the *British Journal of Photography Annual* for 1988 at pages 196–198. The composition of the bleach solution was modified to comprise 1,3-propylene diamine tetraacetic acid. The exposed and processed samples were evaluated to determine the MTF Percent Response as a function of spatial frequency in the film plane as described above.

The samples were additionally exposed to white light through a graduated density test object and developed according to the C-41 Process as described above. The speed of each color record was ascertained by measuring the Status M density of the dye deposits formed as a function of exposure and processing and determining the exposure required to enable production of a dye density of 0.15 above fog. This exposure value is inversely related the speed of the color record in the photographic sample. Incorporation of quantities of distributed absorber dye cause an increase in the quantity of exposure required to enable production of the desired density. This increase in required exposure corresponds to a speed loss. The percentage of speed in the presence of absorber dye relative to the speed in the absence of absorber dye is calculated as:

$$\frac{\text{Required exposure in absence of distributed dye}}{\text{Required exposure in presence of distributed dye}} \times 100$$

Table 2 (below) lists the MTF Percent Response characteristics of the magenta dye images formed by the green light sensitive layers of the described photographic samples.

TABLE 2

MTF Percent Response of the Green Light Sensitive Layers as a Function of Film Formulation

| Sample[a] | Tabular (A) | Emulsion[b] (B) | Absorber[c] Dye | MTF Percent Response[d] 2.5 c/mm | 5 c/mm | 50 c/mm | 80 c/mm |
|---|---|---|---|---|---|---|---|
| 201 C | 2.2 × 0.08 | 2.1 × 0.09 | No (100%) | 105 | 109 | 63 | 34 |
| 202 I | 2.2 × 0.08 | 2.1 × 0.09 | Yes (65%) | 106 | 111 | 72 | 43 |
| 203 I | 2.2 × 0.08 | 2.1 × 0.09 | Yes (48%) | 106 | 110 | 81 | 49 |
| 204 C | 1.7 × 0.15 | 2.0 × 0.14 | No (100%) | 105 | 109 | 63 | 34 |
| 205 I | 1.7 × 0.15 | 2.0 × 0.14 | Yes (50%) | 107 | 116 | 82 | 50 |
| 306 P | 0.8 × 0.27 | 1.0 × 0.33 | No (100%) | 100 | 98 | 69 | 36 |
| 307 P | 0.8 × 0.27 | 0.8 × 0.27 | Yes (50%) | 100 | 100 | 73 | 49 |
| 408 C | 1.7 × 0.15 | 2.0 × 0.14 | No (100%) | 103 | 104 | 84 | 60 |
| 409 I | 1.7 × 0.15 | 2.0 × 0.14 | Yes (60%) | 105 | 111 | 102 | 72 |
| 410 I | 1.7 × 0.15 | 2.0 × 0.09 | Yes (60%) | 104 | 109 | 100 | 69 |
| 411 C | 2.3 × 0.09 | 2.1 × 0.09 | No (100%) | 101 | 104 | 81 | 56 |
| 412 I | 2.3 × 0.09 | 2.1 × 0.09 | Yes (74%) | 102 | 109 | 92 | 67 |
| 413 I | 2.3 × 0.09 | 2.0 × 0.14 | Yes (76%) | 104 | 110 | 96 | 67 |
| 514 C | 2.3 × 0.09 | 2.1 × 0.09 | No (100%) | 103 | 104 | 83 | 62 |
| 515 C | 2.3 × 0.09 | 2.1 × 0.09 | Yes (93%) | 103 | 104 | 82 | 58 |
| 516 C | 1.7 × 0.15 | 2.0 × 0.14 | Yes (93%) | 103 | 105 | 83 | 64 |
| 517 C | 1.7 × 0.15 | 2.0 × 0.14 | No (100%) | 103 | 105 | 86 | 60 |

[a]Samples are identified as comparison (C), inventive (I), or prior art (P).
[b]Dimensions of tabular grain AgX emulsions as average equivalent circular diameter × thickness (both in microns) in the most green sensitive layer (A) and the most red sensitive layer (B). For the conventional emulsions employed in the prior art comparisons, the equivalent circular diameter only is shown.
[c]Presence of green light absorbing distributed absorber dye within the film structure. Speed loss induced in the green light sensitive element by presence of the distributed dye is shown in parenthesis and expressed as a percent of the speed of the control element not incorporating the distributed dye.
[d]MTF Percent Response at the indicated spatial frequency in the film plane for the magenta dye images formed in the green light sensitive layers.

Table 3 (below) lists the MTF Percent Response characteristics of the cyan dye images formed by the red light sensitive layers of the described photographic samples.

TABLE 3

MTF Percent Response of the Red Light Sensitive Layers as a Function of Film Formulation

| Sample[a] | Tabular (A) | Emulsion[b] (B) | Absorber[c] Dye | MTF Percent Response[d] 2.5 c/mm | 5 c/mm | 50 c/mm | 80 c/mm |
|---|---|---|---|---|---|---|---|
| 201 C | 2.2 × 0.08 | 2.1 × 0.09 | No (100%) | 103 | 100 | 24 | 11 |
| 202 I | 2.2 × 0.08 | 2.1 × 0.09 | Yes (58%) | 106 | 107 | 28 | 13 |
| 203 I | 2.2 × 0.08 | 2.1 × 0.09 | Yes (32%) | 106 | 107 | 33 | 16 |
| 204 C | 1.7 × 0.15 | 2.0 × 0.14 | No (100%) | 105 | 105 | 27 | 12 |
| 205 I | 1.7 × 0.15 | 2.0 × 0.14 | Yes (50%) | 107 | 111 | 40 | 18 |
| 408 C | 1.7 × 0.15 | 2.0 × 0.14 | No (100%) | 100 | 96 | 39 | 23 |
| 409 I | 1.7 × 0.15 | 2.0 × 0.14 | Yes (60%) | 105 | 106 | 52 | 28 |
| 410 I | 1.7 × 0.15 | 2.0 × 0.09 | Yes (60%) | 104 | 103 | 48 | 26 |
| 411 C | 2.3 × 0.09 | 2.1 × 0.09 | No (100%) | 99 | 91 | 29 | 21 |
| 412 I | 2.3 × 0.09 | 2.1 × 0.09 | Yes (74%) | 102 | 102 | 47 | 26 |
| 413 I | 2.3 × 0.09 | 2.0 × 0.14 | Yes (76%) | 104 | 107 | 48 | 28 |
| 514 C | 2.3 × 0.09 | 2.1 × 0.09 | No (100%) | 105 | 98 | 34 | 18 |
| 515 C | 2.3 × 0.09 | 2.1 × 0.09 | Yes (93%) | 104 | 97 | 33 | 18 |
| 516 C | 1.7 × 0.15 | 2.0 × 0.14 | Yes (93%) | 106 | 100 | 36 | 19 |
| 517 C | 1.7 × 0.15 | 2.0 × 0.14 | No (100%) | 106 | 102 | 40 | 19 |

[a]Samples are identified as comparison (C), inventive (I), or prior art (P).
[b]Dimensions of tabular grain AgX emulsions as average equivalent circular diameter × thickness (both in microns) in the most green sensitive layer (A) and the most red sensitive layer (B). For the conventional emulsions employed in the prior art comparisons, the equivalent circular diameter only is shown.
[c]Presence of red light absorbing distributed absorber dye within the film structure. Speed loss induced in the red light sensitive element by presence of the distributed dye is shown in parenthesis and expressed as a percent of the speed of the control element not incorporating the distributed dye.
[d]MTF Percent Response at the indicated spatial frequency in the film plane for the cyan dye images formed in the red light sensitive layers.

As is readily apparent upon examination of the photographic data shown in Tables 2 & 3, the photographic samples of this invention comprising sensitized high aspect ratio tabular grain emulsions and a distributed absorber dye which absorbs sufficient light in the region of the spectrum to which the emulsions are sensitized to cause a speed loss of about 20% show improved sharpness performance.

The magnitude of this improvement is surprisingly larger than that which would have been predicted considering the prior art. Table 2 shows a comparison between the prior art samples 306 & 307 which use conventional morphology silver halide emulsions without and with an incorporated distributed absorbing dye and the comparative samples and inventive samples, in particular samples 201 vs. 202 & 203; 204 vs. 205; 408 vs 409 & 410; 411 vs 412 & 413.

Comparative samples 514 vs. 515 and 516 vs. 517 illustrate that this improvement in sharpness is not apparent when lesser quantities of distributed absorber dye are included in the film structure. These lesser quantities are like those commonly employed in color films for purposes related to ease of manufacture to adjust emulsion speed to agree with a production film's rated speed.

Photographic Example 3

This example relates to the color reversal processing of Photographic Samples 201 through 205, the preparation of which was previously described.

These samples showed a dry film thickness of about 20 microns as measured from the photosensitive layer that is farthest form the support to the photosensitive layer that is nearest the support.

The samples were exposed exactly as described in Photographic Example 2 to determine the MTF Percent Response as a function of spatial frequency. The samples were developed using the E-6 Color Reversal Process as described at the *British Journal of Photography Annual* for 1982 at pages 201–203. This is like the Color Reversal Process described starting at U.S. Pat. No. 4,956,269, column 66, line 46.

Under these exposure and processing conditions the color negative film was totally fogged and showed no discernable image. Films intended for color negative processing are typically not directly compatible with color reversal processing while films designed for color reversal processing are typically not directly compatible with color negative processing. Properly processed color reversal films typically are designed to exhibit much higher gammas and much shorter latitude than are properly processed color negative films.

Additional samples of Photographic Samples 201 through 205 were exposed using the procedure described above but using 120 times the exposure. These were then processed according to the E-6 Color Reversal Process to enable the production of Status M densities like those produced upon Color Negative Processing of these same samples as described in Photographic Example 2. This 120× increase in exposure enabled the production of a discernable image after the Color Reversal Process and the MTF Percent Response Characteristics were determined for Photographic Samples 201 through 205 as a function of spatial frequency. These results are shown for magenta dye images formed in the green light sensitive layers and for the cyan dye images formed in the red light sensitive layers-respectively in Tables 4 and 5 below.

TABLE 4

MTF Percent Response of the Green Light Sensitive Layers After Color Reversal Processing as a Function of Film Formulation

| Sample[a] | Tabular (A) | Emulsion[b] (B) | Absorber[c] Dye | MTF Percent Response[d] 2.5 c/mm | 5 c/mm | 50 c/mm | 80 c/mm |
|---|---|---|---|---|---|---|---|
| 201 C | 2.2 × 0.08 | 2.1 × 0.09 | No (100%) | 100 | 97 | 25 | 13 |
| 202 I | 2.2 × 0.08 | 2.1 × 0.09 | Yes (69%) | 102 | 102 | 35 | 18 |
| 203 I | 2.2 × 0.08 | 2.1 × 0.09 | Yes (60%) | 103 | 103 | 33 | 18 |
| 204 C | 1.7 × 0.15 | 2.0 × 0.14 | No (100%) | 101 | 99 | 31 | 15 |
| 205 I | 1.7 × 0.15 | 2.0 × 0.14 | Yes (55%) | 102 | 100 | 32 | 18 |

[a]Samples are identified as comparison (C) or inventive (I).
[b]Dimensions of tabular grain AgX emulsions as average equivalent circular diameter × thickness in the most green light sensitive layer (A) and the most red light sensitive layer (B).
[c]Presence of green light absorbing distributed absorber dye within the film structure. Speed loss induced in the green light sensitive element by presence of the distributed dye is shown in parenthesis and expressed as a percent of the speed of the control element not incorporating the distributed dye.
[d]MTF Percent Response at the indicated spatial frequency in the film plane for the magenta dye images formed in the green light sensitive layers.

TABLE 5

MTF Percent Response of the Red Light Sensitive Layers After Color Reversal Processing as a Function of Film Formulation

| Sample[a] | Tabular (A) | Emulsion[b] (B) | Absorber[c] Dye | MTF Percent Response[d] 2.5 c/mm | 5 c/mm | 50 c/mm | 80 c/mm |
|---|---|---|---|---|---|---|---|
| 201 C | 2.2 × 0.08 | 2.1 × 0.09 | No (100%) | 96 | 76 | 9 | <4 |
| 202 I | 2.2 × 0.08 | 2.1 × 0.09 | Yes (60%) | 101 | 97 | 13 | 5 |
| 203 I | 2.2 × 0.08 | 2.1 × 0.09 | Yes (32%) | 102 | 99 | 15 | 7 |
| 204 C | 1.7 × 0.15 | 2.0 × 0.14 | No (100%) | 99 | 91 | 12 | <4 |
| 205 I | 1.7 × 0.15 | 2.0 × 0.14 | Yes (31%) | 102 | 99 | 16 | 6 |

[a]Samples are identified as comparison (C) or inventive (I).
[b]Dimensions of tabular grain AgX emulsions as average equivalent circular diameter × thickness in the most green light sensitive layer (A) and the most red light sensitive layer (B).
[c]Presence of red light absorbing distributed absorber dye within the film structure. Speed loss induced in the red light sensitive element by presence of the distributed dye is shown in parenthesis and expressed as a percent of the speed of the control element not incorporating the distributed dye.
[d]MTF Percent Response at the indicated spatial frequency in the film plane for the cyan dye images formed in the red light sensitive layers.

As is readily apparent on examination of the photographic data presented in Tables 4 & 5, the photographic compositions of this invention comprising sensitized high aspect ratio tabular grain emulsions enable improved sharpness performance at both low and high spatial frequencies when these compositions are developed using a Color Reversal Image forming process. This is true even though the thickness of the film layers was about 20 microns.

Preparative Photographic Example 4

A comparative control color photographic recording material (Photographic Sample 601) for color negative development was prepared by applying the following layers in the given sequence to a transparent support of cellulose acetate. The quantity of silver halide present is reported in grams of silver per square meter.

Layer 1 (imaging Layer) Green sensitized tabular silver iodobromide emulsion [4.1 mol % iodide, average grain diameter 1.0 microns, average thickness 0.09 microns] at 1.08 g, image dye-forming coupler C-1 at 0.65 g and gelatin at 2.96 g.

Layer 2 (protective layer) gelatin at 1.61 g.

This film was hardened at coating with 2.0% by weight of total gelatin of hardener H-1. Surfactants, coating aids, and such were added to the various layers of this sample as is commonly practiced in the art. This sample had a total thickness above the support of about 5 microns and a total imaging layer thickness from the portion of an imaging layer closest to the support to a portion of an imaging layer furthest from the support of about 4 microns.

Photographic Samples 602 through 606 were like photographic sample 601 except that DIR compound D-6 was added to Layer 1 at 0.00527 g for sample 602, 0.00893 g for sample 603, 0.0269 g for sample 604, 0.0441 g for sample 605 and 0.0893 g for sample 606. The corresponding molar quantities relative to total sensitized silver halide are listed in Table 6.

Photographic Samples 701 through 706 were like samples 601 through 606 respectively except that 0.043 g of soluble green light absorber dye SOL-M1 was additionally added to Layer 1 and allowed to distribute through the coating structure.

Comparative Photographic Example 5

Portions of Photographic Samples 601–706 were exposed to white light through a graduated density test object. Additional portions were individually exposed using white light to sinusoidal patterns to determine the MTF (modulation transfer function) response as a function of spatial frequency in the film plane. Specific details of this exposure and its evaluation can be found in R. L. Lamberts and F. C. Eisen, "A System for the Automated Evaluation of Modulation Transfer Functions of Photographic Materials", in the Journal of Applied Photographic Engineering, Vol. 6, pages 1–8, February 1980. The exposed samples were then processed using a color negative process, the KODAK C-41 process, as described in the British Journal of Photography Annual of 1988 in pages 196–198 (KODAK is a trademark of the Eastman Kodak Company, U.S.A.). The bleach used in the process was modified so as to contain 1,3-propylene diamine tetraacetic acid. The relative sensitivity and the MTF of the processed samples was characterized as described previously.

Samples 701 through 706, all of which contained the distributed dye showed, on average 74% of the sensitivity of corresponding samples 601 through 606.

Additional portions of these same samples were identically exposed both to the graduated density test object and to the sinusoidal image patterns as described above and then developed using the E-6 Color Reversal Process as described at the British Journal of Photography Annual for 1982 at pages 201–203. The MTF of the processed samples was again characterized as described previously.

Results of these comparative tests are listed in Table 6.

TABLE 6

MTF Percent Response as a function of DIR compound level, image forming process, and distributed dye presence.

| Sample | DIR level | Distributed Dye | Process | MTF Percent Response 2.5 lines/mm | MTF Percent Response 50 lines/mm |
|---|---|---|---|---|---|
| 601 | none | no | Negative | 86% | 56% |
| 602 | 0.06 mol % | no | Negative | 86% | 56% |
| 603 | 0.10 mol % | no | Negative | 87% | 59% |
| 604 | 0.30 mol % | no | Negative | 88% | 62% |
| 605 | 0.49 mol % | no | Negative | 91% | 72% |
| 606 | 1.0 mol % | no | Negative | 100% | 90% |
| 701 | none | yes | Negative | 96% | 67% |

TABLE 6-continued

MTF Percent Response as a function of DIR compound level, image forming process, and distributed dye presence.

| Sample | DIR level | Distributed Dye | Process | MTF Percent Response 2.5 lines/mm | MTF Percent Response 50 lines/mm |
|---|---|---|---|---|---|
| 702 | 0.06 mol % | yes | Negative | 96% | 67% |
| 703 | 0.10 mol % | yes | Negative | 98% | 68% |
| 704 | 0.30 mol % | yes | Negative | 98% | 76% |
| 705 | 0.49 mol % | yes | Negative | 100% | 84% |
| 706 | 1.0 mol % | yes | Negative | 115% | 110% |
| 601 | none | no | Reversal | 78% | 44% |
| 602 | 0.06 mol % | no | Reversal | 78% | 45% |
| 603 | 0.10 mol % | no | Reversal | 78% | 46% |
| 604 | 0.30 mol % | no | Reversal | 78% | 44% |
| 605 | 0.49 mol % | no | Reversal | 79% | 45% |
| 606 | 1.0 mol % | no | Reversal | 78% | 45% |
| 701 | none | yes | Reversal | 83% | 49% |
| 702 | 0.06 mol % | yes | Reversal | 82% | 51% |
| 703 | 0.10 mol % | yes | Reversal | 84% | 48% |
| 704 | 0.30 mol % | yes | Reversal | 84% | 53% |
| 705 | 0.49 mol % | yes | Reversal | 83% | 51% |
| 706 | 1.0 mol % | yes | Reversal | 82% | 51% |

As can be readily appreciated on examination of the data reported in Table 6, the MTF response improved to a small extent on addition of the distributed dye in either process sequence but it is only in the Negative Image forming process as illustrated by samples 703–706 that the presence and relative quantity of DIR compound becomes a significant factor in further improving MTF percent response.

Preparative and Comparative Example 6

Photographic Samples 801 through 906 were prepared as described in Example 4 in a manner exactly analogous to samples 601 through 706 except that a red light sensitized tabular grain silver halide emulsion was employed in place of the green light sensitive emulsion and a red light absorbing distributed dye, SOL-C1 was employed in place of SOL-M1.

These samples were then evaluated in exactly the same manner as described in Example 5. Samples 901 through 906 showed 72% of the sensitivity of samples 801 through 806. The same dependence of MTF percent response on DIR level in a Negative image forming process was again observed while no dependence of MTF response on DIR level was observed in a Reversal image forming process.

TABLE 7

MTF Percent Response as a function of DIR compound level, image forming process, and red light absorbing distributed dye presence with a red sensitized emulsion.

| Sample | DIR level | Distributed Dye | Process | MTF Percent Response 2.5 lines/mm | MTF Percent Response 50 lines/mm |
|---|---|---|---|---|---|
| 801 | none | no | Negative | 89% | 57% |
| 802 | 0.06 mol % | no | Negative | 90% | 55% |
| 803 | 0.10 mol % | no | Negative | 88% | 56% |
| 804 | 0.30 mol % | no | Negative | 88% | 57% |
| 805 | 0.49 mol % | no | Negative | 98% | 76% |
| 806 | 1.0 mol % | no | Negative | 114% | 80% |
| 901 | none | yes | Negative | 90 | 56% |
| 902 | 0.06 mol % | yes | Negative | 90% | 56% |
| 903 | 0.10 mol % | yes | Negative | 91% | 58% |
| 904 | 0.30 mol % | yes | Negative | 96% | 61% |
| 905 | 0.49 mol % | yes | Negative | 104% | 88% |
| 906 | 1.0 mol % | yes | Negative | 119% | 98% |
| 801 | none | no | Reversal | 86% | 49% |
| 802 | 0.06 mol % | no | Reversal | 86% | 49% |
| 803 | 0.10 mol % | no | Reversal | 86% | 46% |
| 804 | 0.30 mol % | no | Reversal | 84% | 49% |
| 805 | 0.49 mol % | no | Reversal | 86% | 49% |

TABLE 7-continued

MTF Percent Response as a function of DIR compound level, image forming process, and red light absorbing distributed dye presence with a red sensitized emulsion.

| Sample | DIR level | Distributed Dye | Process | MTF Percent Response 2.5 lines/mm | MTF Percent Response 50 lines/mm |
|---|---|---|---|---|---|
| 806 | 1.0 mol % | no | Reversal | 87% | 50% |
| 901 | none | yes | Reversal | 84% | 49% |
| 902 | 0.06 mol % | yes | Reversal | 86% | 50% |
| 903 | 0.10 mol % | yes | Reversal | 87% | 52% |
| 904 | 0.30 mol % | yes | Reversal | 87% | 51% |
| 905 | 0.49 mol % | yes | Reversal | 88% | 50% |
| 906 | 1.0 mol % | yes | Reversal | 88% | 51% |

As can be readily appreciated on examination of the data reported in Table 7, the MTF response improved to a small extent on addition of the distributed dye in either process sequence, but it is only in the Negative Image forming process with samples 903 through 906 according to the present invention that the presence and relative quantity of DIR compound become a significant factor in further improving MTF percent response.

Preparative Photographic Example 7

A comparative control color photographic recording material (Photographic Sample 1001) for color negative development was prepared by applying the following layers in the given sequence to a transparent support of cellulose acetate. The quantity of silver halide present is reported in grams of silver per square meter, all other quantities are reported as grams per square meter. The imaging couplers and other compounds were emulsified and provided as photographic dispersions as described earlier.

Layer 1 {Antihalation Layer} black colloidal silver sol containing 0.15 g/m2 of silver, dye UV-1 at 0.075 g, dye UV-2 at 0.075 g, FIM-2 at 0.11 g, dye MD-1 at 0.14 g/m2, dye CD-2 at 0.034 g/m2, scavenger S-2 at 0.16 g, with 2.44 g gelatin.

Layer 2 {Lowest Sensitivity Red-Sensitive Layer} A blend of slower red sensitized tabular silver iodobromide emulsion [1.3 mol % iodide, average grain diameter 0.50 micron, average grain thickness 0.08 micron] at 0.41 g and faster red sensitized tabular silver iodobromide emulsion [4.1 mol % iodide, average grain diameter 1.0 micron, average grain thickness 0.09 micron] at 0.44 g, cyan dye-forming image coupler C-1 at 0.54 g, masking coupler CM-1 at 0.027 g, bleach accelerator B-1 at 0.038 g, and gelatin at 1.77 g.

Layer 3 {Medium Sensitivity Red-Sensitive Layer} Red sensitized tabular silver iodobromide emulsion [4.1 mol % iodide, average grain diameter 1.3 microns, average grain thickness 0.12 micron] at 0.70 g, cyan dye-forming image coupler C-1 at 0.23 g, DIR compound D-3 at 0.011 g, cyan dye-forming masking coupler CM-1 at 0.022 g, and gelatin at 1.62 g.

Layer 4 {Highest Sensitivity Red-Sensitive Layer} Red sensitized tabular silver iodobromide emulsion [4.1 mol % iodide, average grain diameter 2.8 microns, average grain thickness 0.12 microns] at 1.08 g, cyan dye-forming image coupler C-1 at 0.14 g, DIR compound D-3 at 0.02 g, DIR compound D-1 at 0.048 g, cyan dye-forming masking coupler CM-1 at 0.032 g, and gelatin at 1.63 g.

Layer 5 {Interlayer} Gelatin at 1.29 g.

Layer 6 {Lowest Sensitivity Green-Sensitive Layer} Green sensitized tabular silver iodobromide emulsion [4.1 mol % iodide, average grain diameter 1.0 microns, average thickness 0.09 microns] at 0.28 g, green sensitized tabular silver iodobromide emulsion [1.3 mol % iodide, average grain diameter 0.54 microns, average thickness 0.08 microns] at 0.54 g, magenta dye-forming image coupler M-4 at 0.26 g, masking coupler MM-1 at 0.065 g, and gelatin at 1.72 g.

Layer 7 {Medium Sensitivity Green-Sensitive Layer} Green sensitized tabular silver iodobromide emulsion [4.1 mol % iodide, average grain diameter 1.3 microns, average thickness 0.13 microns] at 0.97 g, magenta dye-forming image coupler M-4 at 0.081 g, DIR compound D-3 at 0.024 g, magenta dye-forming masking coupler MM-1 at 0.065 g, and gelatin at 1.43 g.

Layer 8 {Highest Sensitivity Green-Sensitive Layer} Green sensitized tabular silver iodobromide emulsion [4.1 mol % iodide, average grain diameter 2.3 microns, average grain thickness 0.13 microns]at 0.97 g, magenta dye-forming image coupler M-4 at 0.062 g, magenta dye-forming masking coupler FIM-1 at 0.054 g, DIR compound D-2 at 0.011 g, DIR compound D-7 at 0.011 g, and gelatin at 1.28 g.

Layer 9 {Interlayer} Yellow filter dye YD-2 at 0.11 g, and gelatin at 1.29 g.

Layer 10 {Lowest Sensitivity Blue-Sensitive Layer} A blend of blue sensitized tabular silver iodobromide emulsion [1.3 mol % iodide, average grain diameter 0.53 microns, average grain thickness 0.09 micron]at 0.22 g, blue sensitized tabular silver iodobromide emulsion [6.0 mol % iodide, average grain diameter 0.95 microns, average grain thickness 0.25 micron]at 0.64 g, yellow dye-forming image coupler Y-1 at 0.70 g, yellow dye-forming image coupler Y-2 at 0.28 g, cyan dye-forming image coupler C-1 at 0.016 g, DIR compound D-4 at 0.065 g, processing sensitivity stabilizing coupler B-1 at 0.003 g, and gelatin at 2.51 g.

Layer 11 {Highest Sensitivity Blue-Sensitive Layer} Blue sensitized low aspect ratio tabular silver iodobromide emulsion [9.0 mol % iodide, average grain diameter 1.05 microns, average grain thickness 0.35 microns] at 0.40 g/m2, blue sensitized tabular silver iodobromide emulsion [4.1 mol % iodide, average grain diameter 3.3 microns, average grain thickness 0.14 microns] at 0.23 g, yellow dye-forming image coupler Y-1 at 0.22 g, yellow dye-forming image coupler Y-2 at 0.08 g, cyan dye-forming image coupler C-1 at 0.016 g, processing sensitivity stabilizing coupler B-1 at 0.005 g, DIR compound D-4 at 0.048 g, and gelatin at 1.61 g.

Layer 12 {Protective Layer 1} 0.108 g of dye UV-1, 0.118 g of dye UV-2, unsensitized silver bromide Lippmann emulsion at 0.22 g, anti-matte polymethylmethacrylate beads at 0.054 g, and gelatin at 1.07 g.

This film was hardened at coating with 1.7% by weight of total gelatin of hardener H-1. Surfactants, coating aids, scavengers and stabilizers were added to the various layers of this sample as is commonly practiced in the art. This sample had a total thickness above the support of about 25 microns and a total imaging layer thickness from the portion of an imaging layer closest to the support to a portion of an imaging layer furthest from the support of about 21 microns. The quantity of DIR incorporated in sample 1001 expressed as a mol % relative to the quantity of sensitized silver halide was about 0.45 mol %.

Photographic Sample 1002 was like sample 1001 except that only one-half the quantity of DIR compound was employed.

Photographic Sample 1003 was like sample 1001 except that the DIR compounds were omitted.

Photographic Samples 1004 through 1006 were like samples 1001 through 1003 respectively except that 0.0215 g of SOL-C1, 0.0323 g of SOL-M1, and 0.11 g of SOL-Y1 were added to each.

Comparative Photographic Example 8

Portions of Photographic Samples 1001 through 1006 were exposed to white light through a graduated density test object. Additional portions were individually exposed using white light to sinusoidal patterns to determine the MTF (modulation transfer function) response as a function of spatial frequency in the film plane. Specific details of this exposure and its evaluation can be found in R. L. Lamberts and F. C. Eisen, "A System for the Automated Evaluation of Modulation Transfer Functions of Photographic Materials", in the Journal of Applied Photographic Engineering, Vol. 6, pages 1–8, February 1980. The exposed samples were then processed using a color negative process, the KODAK C-41 process, as described in the British Journal of Photography Annual of 1988 in pages 196–198 (KODAK is a trademark of the Eastman Kodak Company, U.S.A.). The bleach used in the process was modified so as to contain 1,3-propylene diamine tetraacetic acid. The relative sensitivity and the MTF of the processed samples was characterized as described previously.

Samples 1004 through 1006 all of which contained the distributed dye showed, on average 74% of the sensitivity of corresponding samples 1001 through 3.

Additional portions of these same samples were identically exposed both to the graduated density test object and to the sinusoidal image patterns as described above and then developed using the E-6 Color Reversal Process as described at the British Journal of Photography Annual for 1982 at pages 201–203. The MTF of the processed samples was again characterized as described previously.

Results of these comparative tests are listed in Table 8.

TABLE 8

MTF Percent Response as a function of DIR compound level, image forming process, and distributed dye presence.

| Sample | DIR level | Distributed Dye | Process | MTF Percent Response at 20 lines per mm Blue | Green | Red |
|---|---|---|---|---|---|---|
| 1001 | 0.45 mol % | no | Negative | 118% | 101% | 62% |
| 1002 | 0.22 mol % | no | Negative | 103% | 81% | 50% |
| 1003 | none | no | Negative | 94% | 69% | 42% |
| 1004 | 0.45 mol % | yes | Negative | 132% | 121% | 76% |
| 1005 | 0.22 mol % | yes | Negative | 114% | 95% | 60% |
| 1006 | none | yes | Negative | 106% | 76% | 51% |
| 1001 | 0.45 mol % | no | Reversal | 72% | 59% | 33% |
| 1002 | 0.22 mol % | no | Reversal | 71% | 59% | 33% |
| 1003 | none | no | Reversal | 72% | 56% | 30% |
| 1004 | 0.45 mol % | yes | Reversal | 82% | 69% | 40% |
| 1005 | 0.22 mol % | yes | Reversal | 83% | 70% | 40% |
| 1006 | none | yes | Reversal | 85% | 68% | 40% |

As can be readily appreciated on examination of the data reported in Table 8, the MTF response improved to a small extent on addition of the distributed dye in either process sequence but it is only in the Negative Image forming process sequence that the presence and relative quantity of DIR compound become a significant factor in further improving MTF percent response and useful image sharpness.

Preparative and Comparative Example 9

Photographic Sample A was prepared in a manner analogous to sample 1004 described above except that the total quantity of incorporated silver, vehicle and organics was reduced so as to enable a thinner film structure while maintaining other useful properties and otherwise maintaining the composition within the useful bounds previously described.

This sample had two blue light sensitive layers, three green light sensitive layers and three red light sensitive layers, along with auxiliary layers as shown earlier. The sample exhibited a total thickness above the support of about 20 microns and a total imaging layer thickness from the portion of an imaging layer closest to the support to a portion of an imaging layer furthest from the support of about 14 microns. The total quantity of imaging silver was about 2.7 grams per square meter and the quantity of DIR incorporated in Sample A expressed as a mol % relative to the quantity of sensitized silver halide was about 0.56 mol %.

Sample A was exposed, processed as a color negative film and evaluated as described earlier. It exhibited excellent MTF % response and sharpness.

Preparative and Comparative Example 10

Photographic Sample B was prepared in a manner analogous to sample 1004 described above except that emulsion grain diameters were increased so as to enable higher sensitivity while maintaining other useful properties and otherwise maintaining the composition within the useful bounds previously described.

Sample B was exposed, processed as a color negative film and evaluated as described earlier. It exhibited excellent MTF % response and sharpness. It showed a sensitivity in excess of ISO 800.

The invention has been described in detail with particular reference to preferred embodiments thereof, but it will be understood that variations and modifications can be effected within the spirit and scope of the invention.

We claim:

1. A color negative photographic recording material comprising a support bearing:

at least one photographic layer comprising a sensitized tabular grain silver halide emulsion having an average aspect ratio greater than about 8;

an image dye forming coupler;

at least one color dye forming development inhibitor releasing coupler; and at least one distributed dye that absorbs light in the region of the spectrum to which said sensitized tabular grain silver halide emulsion having an aspect ratio greater than about 8 is sensitized wherein;

the quantity of said at least one distributed dye is such as to reduce the sensitivity of said at least one photographic layer containing said sensitized tabular grain silver halide emulsion having an aspect ratio greater than about 8 by at least 20%; and the quantity of said at least one development inhibitor releasing compound being greater than about 0.07 mole percent relative to the total quantity of sensitized silver halide emulsion in said at least one photographic layer and with the proviso that said high aspect ratio tabular grain emulsion and said color dye forming development inhibitor releasing coupler are in reactive association and said development inhibitor released by said color dye forming development inhibitor releasing coupler changes in structure and effect as a result of photographic processing.

2. A material according to claim 1 wherein said sensitized tabular grain silver halide emulsion has an aspect ratio greater than about 10.

3. A material according to claim 1 wherein the quantity of said at least one distributed dye is such as to reduce the sensitivity of said at least one photographic layer containing said sensitized tabular grain silver halide emulsion having an aspect ratio greater than about 8 by at least 25%.

4. A material according to claim 1 wherein the quantity of all development inhibitor releasing compounds is between about 0.10 mole percent and 5 mol percent relative to the total quantity of sensitized silver halide emulsion.

5. A material according to claim 1 wherein said high aspect ratio tabular grain emulsion and said color dye forming development inhibitor releasing coupler are in the same light sensitive layer.

6. A material according to claim 1 comprising a red light sensitive color record comprising at least one red light sensitive silver halide emulsion and at least one cyan dye forming image coupler, a green light sensitive color record comprising at least one green light sensitive silver halide emulsion and at least on magenta dye forming image coupler and a blue light sensitive color record comprising at least one blue light sensitive silver halide emulsion and at least one yellow dye forming image dye forming coupler all on the same side of said support.

7. A material according to claim 6 wherein at least one of said color records comprises two or three light sensitive layers differing in sensitivity.

8. A material according to claim 6 wherein said sensitized tabular grain silver halide emulsion is located in the most light sensitive layer of said red light sensitive color record, green light sensitive color record, blue light sensitive color record.

9. A material according to claim 1 comprising a total silver content of between about 1 and 10 grams per square meter of light sensitive silver in said material.

10. A material according to claim 1 wherein said sensitized tabular grain silver halide emulsion having an average aspect ratio greater than about 18 is sensitive to a portion of the electromagnetic spectrum chosen from red light, green light or blue light.

11. A process of forming a color negative image comprising providing an imagewise exposed color photographic recording material comprising a support bearing:

at least one photographic layer comprising a sensitized tabular grain silver halide emulsion having an average aspect ratio greater than about 8;

an image dye forming coupler;

at least one color dye forming development inhibitor releasing coupler;

at least one distributed dye that absorbs light in the region of the spectrum to which said sensitized tabular grain silver halide emulsion having an aspect ratio greater than about 8 is sensitized;

contacting said recording material with color developing agent to reduce developable silver halide and oxidize said color developing agent, the oxidized color developing agent in turn reacting with said color dye forming development inhibitor releasing coupler to yield a dye;

forming a color negative image;

wherein the quantity of said at least one distributed dye being such as to reduce the sensitivity of said at least one photographic layer containing said sensitized tabular grain silver halide emulsion having an aspect ratio greater than about 8 by at least 20%; and the quantity of said at least one development inhibitor releasing compounds being greater than about 0.07 mole percent relative to the total quantity of sensitized silver halide emulsion in said at least one photographic layer with the proviso that said high aspect ratio tabular grain emulsion and said color forming development inhibitor releasing coupler are in reactive association and said color forming development inhibitor releasing coupler changes in structure and effect as a result of photographic processing.

12. A process according to claim 11 comprising contacting said recording material with a bleach, a fixer, or a bleach fixer.

13. A process according to claim 11 wherein said sensitized tabular grain silver halide emulsion has an aspect ratio greater than about 10.

14. A process according to claim 11 wherein the quantity of said at least one distributed dye is such as to reduce the sensitivity of said at least one photographic layer containing said sensitized tabular grain silver halide emulsion having an aspect ratio greater than about 8 by at least 25%.

15. A process according to claim 11 wherein the quantity of all development inhibitor releasing compounds is between about 0.10 mole percent and 5 mol percent relative to the total quantity of sensitized silver halide emulsion.

16. A process according to claim 11 wherein said color developing agent is a paraphenylene diamine color developing agent.

17. A process according to claim 11 wherein the material comprises a red light sensitive color record comprising at least one red light sensitive silver halide emulsion and at least one cyan dye forming image coupler, a green light sensitive color record comprising at least one green light sensitive silver halide emulsion and at least one magenta dye forming image coupler and a blue light sensitive color record comprising at least one blue light sensitive silver halide emulsion and at least one yellow dye forming image dye forming coupler all on the same side of said support.

18. A process according to claim 17 wherein at least one of said red light sensitive color record, green light sensitive color record, blue light sensitive color record comprises two or three light sensitive layers differing in sensitivity.

19. A process according to claim 18 wherein said sensitized tabular grain silver halide emulsion is located in the most light sensitive layer of said red light sensitive color record, green light sensitive color record, blue light sensitive color record.

20. A process according to claim 11 wherein said recording material comprises a total silver content between about 1 and 10 grams per square meter of light sensitive silver in said material.

21. A process according to claim 11 wherein said sensitized tabular grain silver halide emulsion having an average aspect ratio greater than about 8 is sensitive to a portion of the electromagnetic spectrum chosen from red light, green light or blue light.

* * * * *